US007066787B2

(12) United States Patent
Nakanishi et al.

(10) Patent No.: US 7,066,787 B2
(45) Date of Patent: Jun. 27, 2006

(54) SUBSTRATE PROCESSING APPARATUS

(75) Inventors: Masayuki Nakanishi, Tokyo (JP); You Ishii, Tokyo (JP); Kenro Nakamura, Kamakura (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 192 days.

(21) Appl. No.: 10/765,147

(22) Filed: Jan. 28, 2004

(65) Prior Publication Data

US 2004/0185751 A1 Sep. 23, 2004

(30) Foreign Application Priority Data

Feb. 3, 2003 (JP) ..... 2003-026367

(51) Int. Cl.
*B24B 49/00* (2006.01)
*B24B 51/00* (2006.01)
*B24B 7/00* (2006.01)

(52) U.S. Cl. ..... 451/6; 451/8; 451/67; 451/297; 451/302; 451/303; 451/311; 451/339; 451/451

(58) Field of Classification Search ..... 451/5, 451/6, 8, 9, 10, 11, 43, 44, 54, 59, 67, 297, 451/299, 302, 303, 307, 311
See application file for complete search history.

(56) References Cited

U.S. PATENT DOCUMENTS 5,733,181 A * 3/1998 Hasegawa et al. ..... 451/168
5,816,274 A * 10/1998 Bartram et al. ..... 134/140
6,102,776 A * 8/2000 Boggs et al. ..... 451/8
6,104,481 A * 8/2000 Sekine et al. ..... 356/237.5
6,126,512 A * 10/2000 Chao et al. ..... 451/9
6,306,016 B1 * 10/2001 Steere et al. ..... 451/44
6,475,293 B1 * 11/2002 Moinpour et al. ..... 134/6
6,527,629 B1 * 3/2003 Sandvold ..... 451/296
6,933,234 B1 * 8/2005 Nakamura et al. ..... 438/690
2003/0139049 A1 7/2003 Nakamura et al.
2004/0106363 A1 6/2004 Ishii et al.

FOREIGN PATENT DOCUMENTS

JP 2003-163188 6/2003
JP 2003-234314 8/2003

* cited by examiner

*Primary Examiner*—Timothy V. Eley
(74) *Attorney, Agent, or Firm*—Wenderoth, Lind & Ponack, L.L.P.

(57) ABSTRACT

A substrate processing apparatus is used for removing surface irregularities occurring on a peripheral portion (a bevel portion, an edge portion, and a notch) of a substrate, such as a semiconductor wafer, and films deposited as a contaminant on the peripheral portion of such a substrate. The substrate processing apparatus includes an edge-portion polisher for pressing a polishing tape against an edge portion of a substrate and causing relative movement between the polishing tape and the substrate to polish the edge portion of the substrate, and a bevel-portion polisher for pressing a polishing tape against a bevel portion of the substrate and causing relative movement between this polishing tape and the substrate to polish the bevel portion of the substrate.

20 Claims, 23 Drawing Sheets

SUBSTRATE PROCESSING APPARATUS

BACKGROUND OF THE INVENTION

1. Field of the Invention

The present invention relates to a substrate processing apparatus, and more particularly to a substrate processing apparatus for removing surface irregularities occurring on a peripheral portion (a bevel portion, an edge portion, and a notch) of a substrate such as a semiconductor wafer, and films deposited as a contaminant on the peripheral portion of such a substrate.

2. Description of the Related Art

In recent years, according to finer structures of semiconductor elements and higher integration of semiconductor devices, it has become more important to manage particles. One of major problems in managing particles is dust caused by surface roughness produced at a bevel portion and an edge portion of a semiconductor wafer (substrate) in a manufacturing process of semiconductor devices. In this case, as shown in FIG. 22, a bevel portion B means a portion having a curvature in a cross-section of an edge of a semiconductor wafer W, and an edge portion E means a flat portion extending about several millimeters radially inwardly from the bevel portion B of the wafer.

For example, the aforementioned surface roughness caused by processing is produced in an RIE (Reactive Ion Etching) process of forming trenches (deep trenches) for a trench capacitor on a surface of an Si wafer. In an RIE process, as shown in FIG. 23A, a hard mask comprising laminated films composed of an SiN film 500 and an $SiO_2$ film 510 is first formed on Si wafer 100, and then the Si wafer 100 is etched by an RIE method while the hard mask serves as a mask, thereby forming deep trenches 520 (see FIG. 23B).

In this RIE process, by-products produced during etching may be attached to a bevel portion and an edge portion of the Si wafer 100 and serve as masks for etching, thereby forming needle-like projections 530 at the bevel portion and the edge portion of the Si wafer 100, as shown in FIG. 23B. Particularly, in a case of forming, with accuracy, deep trenches 520 having an opening diameter of a submicron and an aspect ratio as high as multiples of ten, the aforementioned needle-like projections 530 are inevitably produced under such process conditions at the bevel portion and the edge portion.

Heights of the needle-like projections 530 vary depending on positions of the needle-like projections 530 and are as large as about 10 μm at their maximum height. The needle-like projections 530 are broken in transferring or processing the Si wafer 100, and thus cause particles to be produced. Since such particles lead to a lower yield, it is necessary to remove the needle-like projections 530 formed at the bevel portion and the edge portion.

A CDE (Chemical Dry Etching) method has heretofore been employed in order to remove such needle-like projections 530. In a CDE method, a resist 540 is first applied on surfaces except for a region of several millimeters which includes the bevel portion and the edge portion of the Si wafer 100, as shown in FIG. 24A. Then, a portion of the Si wafer 100 that is not covered with the resist 540 is isotropically etched to remove the needle-like projections 530 at the bevel portion and the edge portion (see FIG. 24B). Thereafter, the resist 540, which has protected device surfaces, is removed (see FIG. 24C).

With such a CDE method, since device surfaces should be protected by the resist 540, it is necessary to apply a resist and remove the resist. Further, although sharp needle portions can be removed by isotropic etching, irregularities 550 are formed depending on a variation of the heights of the needle-like projections 530 (see FIG. 24C). These types of irregularities 550 may be problematic because dust tends to accumulate in the irregularities 550 during subsequent processes such as CMP (Chemical Mechanical Polishing). However, this conventional CDE method has difficulty in completely removing such surface roughness at the bevel portion and the edge portion of the Si wafer 100. Further, time required for processing a single wafer in a CDE process is usually 5 minutes or more, and hence a CDE process has problems in that it causes a lower throughput and has high material costs.

Further, new materials, such as Cu as a wiring material, Ru and Pt as a capacitor electrode material for next-generation DRAM and FeRAM, and TaO and PZT as a capacitor dielectric material, have recently been introduced in fields of semiconductor devices one after another. Now is the time to seriously consider problems of device contamination caused by these new materials in mass production of semiconductor devices. Particularly, in a manufacturing process of a semiconductor device, since films of new materials which are attached to a bevel portion, an edge, and a reverse face of a wafer may cause contamination, removal of such films represents an important problem.

For example, when an Ru film to be used as a capacitor electrode is deposited, it is important to remove the Ru film attached to a bevel portion, an edge portion, and a reverse face. Currently, a CVD (Chemical Vapor Deposition) method is generally used as a deposition method of such an Ru film. With the CVD method, attachment of an Ru film to a bevel portion, an edge portion, and a reverse face is unavoidable, while degrees of the attachment are different depending on device arrangements. Even if an Ru film is deposited with an edge cut ring by a sputtering method, it is difficult to completely eliminate the attachment of an Ru film to a bevel portion and an edge portion due to wraparounds of sputter particles (Ru). When an edge cut width is reduced in order to increase a yield of peripheral chips, it is more difficult to completely eliminate attachment of an Ru film.

With any deposition method, an Ru film is attached to a bevel portion, edge portion, or a reverse face of a wafer after Ru deposition. As described above, this type of Ru film attached to a bevel portion or the like should be removed because it causes device contamination in subsequent processes.

Removal of an Ru film attached to a bevel portion or the like has heretofore been performed by a wet-etching method. A wet-etching method generally includes dropping a chemical liquid onto an Si wafer being rotated horizontally while a reverse face of the Si wafer faces upwardly. With respect to a bevel portion and an edge portion, removal of an Ru film is performed by adjusting a rotational speed or the like to adjust an amount of the chemical liquid flowing onto a device-formed surface.

However, with this method, because a removal rate of an Ru film is about 10 nm/min, a period of time for processing a single wafer is usually as long as 5 minutes or more, resulting in a lowered throughput. Further, it is impossible to remove Ru diffused in an underlying layer, and, in order to remove such Ru, it is necessary to perform additional wet-etching with another chemical liquid that can etch the underlying layer, resulting in a further lowered throughput. Furthermore, this method has another problem in that there are no adequate chemical liquids that do not damage a device.

SUMMARY OF THE INVENTION

The present invention has been made in view of the above drawbacks. It is therefore an object of the present invention to provide a substrate processing apparatus which is capable of effectively removing surface irregularities occurring on a peripheral portion of a substrate, and films deposited as a contaminant on the peripheral portion of such a substrate in a semiconductor device fabrication process or the like.

In order to achieve the above object, according to a first aspect of the present invention, there is provided a substrate processing apparatus for polishing a substrate, comprising: an edge-portion polisher for pressing a polishing tape against an edge portion of a substrate and causing relative movement between the polishing tape and the substrate to polish the edge portion of the substrate; and a bevel-portion polisher for pressing a polishing tape against a bevel portion of the substrate and causing relative movement between the polishing tape and the substrate to polish the bevel portion of the substrate.

According to a preferred aspect of the present invention, the edge-portion polisher and the bevel-portion polisher are provided in a polishing unit.

According to the first aspect of the present invention, because needle-like projections on bevel and edge portions of the substrate are removed by a polishing process using a polishing tape, it is not necessary to protect a device-formed surface of the substrate which would need to be protected by a resist in the conventional CDE process. As a result, two steps of coating a protective resist and peeling off the protective resist after needle-like projections have been removed can be omitted, resulting in an improved throughput. Since surfaces of the bevel and edge portions from which needle-like projections have been removed are made smooth, the problems of the CDE process are solved.

Because films deposited as a contaminant on a peripheral portion of the substrate are removed by a polishing process using a polishing tape, a removing process can be performed as a single process. Therefore, the films deposited as a contaminant can be removed in a period of time shorter than a period of time required by a conventional wet etching process, resulting in an improved throughput.

The polishing tape may comprise a thin-film polishing tape. Alternatively, the polishing tape may be made of a material which is highly flexible. By using a thin-film polishing tape as the polishing tape, the polishing tape is prevented from being bent over a surface of the substrate, particularly a peripheral portion (the bevel and edge portions) of the substrate. Since the polishing tape is exactly curved so as to be along a curved shape of the peripheral portion of the substrate, the polishing tape can uniformly polish the peripheral portion of the substrate. As a result, needle-like projections formed on the surface of the substrate and unnecessary films attached to the surface of the substrate can effectively be removed by polishing. The term "polishing tape" used herein means a tape-like polishing tool, and includes both a polishing film comprising a base film coated with abrasive particles and a tape-like polishing cloth.

According to a preferred aspect of the present invention, the polishing unit has a notch polisher for pressing a polishing tape against a notch in the substrate and causing relative movement between the polishing tape and the substrate to polish the notch of the substrate. According to the present invention, a single polishing unit can polish the bevel and edge portions of the substrate and the notch in the substrate with the polishing tapes.

According to a preferred aspect of the present invention, the polishing unit has a cleaning device for conducting a primary cleaning of a polished substrate. According to the present invention, after the bevel and edge portions of the substrate and the notch in the substrate have been polished using the polishing tapes of the single polishing unit, the primary cleaning of the substrate can be conducted in the same polishing unit.

According to a preferred aspect of the present invention, the edge-portion polisher is structured to polish the edge-portion of the substrate by clamping upper and lower surfaces of the edge portion of the substrate through the polishing tape by a pair of clamp members while the substrate is held and rotated by a substrate holding table. According to the present invention, the polishing tape is sandwiched and pressed against the upper and lower surfaces of the edge portion of the substrate by a pair of clamp members. The polishing tape may be sandwiched and pressed against the edge portion of the substrate by flat surfaces or roller surfaces. By pressing the polishing tape with the clamp members using an air cylinder or the like, a pressure for pressing the polishing tape against the edge portion of the substrate can be controlled at any desired value.

According to a preferred aspect of the present invention, the clamp members are movable in a radial direction of the substrate for adjusting a radial position of the edge portion to be polished by the edge-portion polisher. According to the present invention, a position of the edge portion to be polished can be adjusted as desired, and a width of the edge portion to be polished can also be adjusted as desired.

According to a preferred aspect of the present invention, the edge-portion polisher further comprises a roller guide for guiding the polishing tape radially outwardly of the substrate to be polished between the clamp members, and for guiding the polishing tape from one of the clamp members toward the other of the clamp members. According to the present invention, the polishing tape is sandwiched and pressed against the edge portion of the substrate by the clamp members, and is guided by the roller guide radially outwardly of an area of the substrate where the polishing tape is sandwiched. Because the polishing tape is once spaced from an area where the polishing tape is held in contact with the substrate, the polishing tape is prevented from being twisted, and the upper and lower surfaces of the edge portion of the substrate can be polished by a single polishing tape.

According to a preferred aspect of the present invention, the edge-portion polisher further comprises a mechanism for opening and closing the clamp members, with the clamp members and the mechanism being vertically movable. According to the present invention, since the clamp members and the opening/closing mechanism which serve as a mechanism for sandwiching the polishing tape are vertically movable, when the clamp members clamp the substrate, the substrate and the clamp members are automatically aligned relatively with each other in a vertical direction. Therefore, the clamp members and the opening/closing mechanism jointly provide a vertically aligning mechanism for automatically adjusting a clamping position of the polishing tape.

According to a preferred aspect of the present invention, the bevel-portion polisher is structured to polish the bevel-portion of the substrate by pressing a polishing tape against the bevel-portion of the substrate with a polishing head having a resilient member while the substrate is held and rotated by a substrate holding table. With the bevel-portion polisher of the present invention, the bevel portion of the substrate is polished by pressing the polishing tape against the bevel portion of the substrate with the polishing head having the resilient member, while the substrate is being rotated about its own axis.

According to a preferred aspect of the present invention, the polishing head is movable in a radial direction of the substrate. According to the present invention, even if the resilient member is deteriorated, a pressing force for pressing the polishing tape against the bevel portion of the substrate can be adjusted.

According to a preferred aspect of the present invention, the notch polisher is structured to polish the notch of the substrate by pressing a polishing tape against the notch in the substrate with a resilient member and moving the polishing tape while the substrate is held by a substrate holding table. With the notch polisher of the present invention, while the polishing tape is being pressed against the notch in the substrate with the resilient member, the polishing tape is moved with respect to the substrate, e.g., in one direction or a reciprocating manner, thereby polishing the notch in the substrate.

According to a preferred aspect of the present invention, the resilient member is vertically movable so that the polishing tape is pressed against an upper edge, a radially outward edge, and a lower edge of the notch, selectively.

According to a preferred aspect of the present invention, the substrate processing apparatus further comprises a cleaning unit for cleaning and drying the substrate after the substrate has been polished by the polishing unit and removed from the polishing unit. According to the present invention, after the bevel and edge portions of the substrate have been polished by the polishing unit, the substrate is unloaded from the polishing unit, and cleaned and dried by the cleaning unit. With the substrate processing apparatus according to the present invention, the bevel and edge portions (and the notch in some cases) of the substrate are polished, and then the substrate is cleaned and dried, and this clean dry substrate is unloaded. Consequently, even if the substrate processing apparatus is installed in a clean room, because a polished substrate is clean and dry, the substrate unloaded from the substrate processing apparatus does not contaminate an atmosphere (clean air) in the clean room. The substrate processing apparatus is enclosed by a housing so that the substrate processing apparatus can be installed in a clean room.

According to a second aspect of the present invention, there is provided a substrate processing apparatus for polishing a substrate, comprising: a pair of clamp members for clamping face and reverse sides of an edge portion of a substrate through a polishing tape; and a mechanism for opening and closing the clamp members; wherein the clamp members are closed by the mechanism to press the polishing tape against the face and reverse sides of the edge portion of the substrate.

According to the second aspect of the present invention, the polishing tape is sandwiched and pressed against the face and reverse sides of the edge portion of the substrate by the pair of clamp members. The polishing tape may be sandwiched and pressed against the edge portion of the semiconductor wafer by flat surfaces or roller surfaces. By pressing the polishing tape with the clamp members using an air cylinder or the like, a pressure for pressing the polishing tape against the edge portion of the substrate can be controlled at any desired value. In embodiments of the present invention, the face side of the edge portion of the substrate is referred to as an upper surface of the edge portion of the substrate, and the reverse side of the edge portion of the substrate is referred to as a lower surface of the edge portion of the substrate.

According to a preferred aspect of the present invention, the substrate processing apparatus further comprises a substrate holding table for holding and rotating the substrate at a predetermined speed.

According to a preferred aspect of the present invention, the substrate processing apparatus further comprises a displacing mechanism for displacing the clamp members and the mechanism in a radial direction of the substrate. According to the present invention, a position of the edge portion to be polished can be adjusted as desired, and a width of the edge portion to be polished can also be adjusted as desired.

According to a preferred aspect of the present invention, the substrate processing apparatus further comprises a roller guide disposed between the clamp members for guiding the polishing tape from one of the clamp members toward the other of the clamp members. According to the present invention, the polishing tape is sandwiched and pressed against the edge portion of the substrate by the clamp members, and is guided by the roller guide radially outwardly of an area of the substrate where the polishing tape is sandwiched. Because the polishing tape is once spaced from an area where the polishing tape is held in contact with the substrate, the polishing tape is prevented from being twisted, and the upper and lower surfaces of the edge portion of the substrate can be polished by a single polishing tape.

According to a preferred aspect of the present invention, the clamp members and the mechanism are supported in a floating manner on a fixed member so that the clamp members and the mechanism are movable in a direction substantially perpendicular to a surface of the substrate. According to the present invention, since the clamp members and the opening/closing mechanism which serve as a mechanism for sandwiching the polishing tape are vertically movable, when the clamp members clamp the substrate, the substrate and the sandwiching mechanism are automatically aligned relatively with each other in the vertical direction. Therefore, the clamp members and the opening/closing mechanism jointly provide a vertically aligning mechanism for automatically adjusting a clamping position of the polishing tape.

According to a third aspect of the present invention, there is provided a substrate processing apparatus for polishing a substrate, comprising: a substrate holding table for holding a substrate; a resilient member for pressing a polishing tape against a notch in the substrate; and a pressing mechanism for pressing the resilient member under a predetermined pressing force to press the polishing tape against the notch in the substrate.

According to the third aspect of the present invention, since the pressing mechanism presses the resilient member to apply a predetermined pressing force to the polishing tape while the substrate is being polished, the substrate can be polished uniformly by the polishing tape at a constant polishing rate regardless of deterioration of the resilient member. The pressing mechanism is arranged so as to be able to adjust a pressing force while the substrate is being polished. Consequently, the pressing force can appropriately be changed by the pressing mechanism to change the pressing force applied to the polishing tape while the substrate is being polished, and hence a desired polishing profile can be obtained in the notch of the substrate.

According to a preferred aspect of the present invention, the substrate processing apparatus further comprises a support arm for supporting the resilient member thereon; and a swinging mechanism for swinging the support arm vertically; wherein the swinging mechanism swings the support arm vertically so that the polishing tape is pressed against an upper edge, a radially outward edge, and a lower edge of the notch, selectively. According to the present invention, because the resilient member which presses the polishing tape can be moved vertically, the notch in the substrate, including slanted upper and lower portions of the notch, can be polished in its entirety, thus reliably removing films deposited as a contaminant in the notch.

According to a preferred aspect of the present invention, the pressing mechanism comprises an air cylinder.

According to a preferred aspect of the present invention, the substrate processing apparatus further comprises an image sensor for imaging a region, being polished, of the substrate while the substrate is being polished; and a controller for processing an image obtained by the image sensor to determine a polishing state of the region being polished. According to the present invention, the polishing state can be grasped by optically observing the region of the substrate which is being polished.

According to a preferred aspect of the present invention, the controller detects a polishing end point from the polishing state of the region being polished.

According to a preferred aspect of the present invention, the substrate processing apparatus further comprises a photosensor for applying light to a region, being polished, of the substrate and detecting light reflected by the region being polished while the substrate is being polished, and a controller for analyzing scattered light detected by the photosensor to determine a polishing state of the region being polished. According to the present invention, the polishing state can be grasped by applying light to the region of the substrate which is being polished and observing scattered light that is reflected from the region being polished.

According to a preferred aspect of the present invention, the controller detects a polishing end point from the polishing state of the region being polished.

According to a preferred aspect of the present invention, the substrate processing apparatus further comprises a controller for detecting a torque value to rotate the substrate on a basis of a signal from a motor for rotating the substrate while the substrate is being polished, and analyzing a change in the torque value. According to the present invention, a torque value to rotate the substrate is detected from a current or the like of a motor which drives a substrate holding table for holding and rotating the substrate, and a change in the torque value is analyzed by being compared with stored data to grasp the polishing state of the region being polished.

According to a preferred aspect of the present invention, the controller detects a polishing end point from the change in the torque value.

According to a preferred aspect of the present invention, the substrate processing apparatus further comprises a controller for detecting a torque value of a rotational shaft of a substrate holding table for holding and rotating the substrate while the substrate is being polished, and analyzing a change in the torque value. According to the present invention, a torque value applied to the rotational shaft of the substrate holding table for holding and rotating the substrate is directly detected, and a change in the torque value is analyzed by being compared with stored data to grasp the polishing state of the region being polished.

According to a preferred aspect of the present invention, the controller detects a polishing end point from the change in the torque value.

According to a preferred aspect of the present invention, the substrate processing apparatus further comprises a controller for measuring a tension applied to the polishing tape which is held in sliding contact with the region, being polished, of the substrate while the substrate is being polished, to determine a polishing state of the region being polished. According to the present invention, a tension (tensile stress) applied to the polishing tape during polishing is measured by a strain gage or the like, and a change in the tension is analyzed by being compared with stored data to grasp the polishing state of the region being polished. For example, when the bevel and edge portions of the substrate are polished, since the polishing tape undergoes a tension in the direction in which the substrate rotates, a change in the tension is observed. When the notch in the substrate is polished, since the polishing tape undergoes a tension in the direction in which the polishing tape moves, a change in the tension is observed.

According to a preferred aspect of the present invention, the substrate processing apparatus further comprises a controller for measuring a tension applied to a portion for pressing the polishing tape against the region, being polished, of the substrate while the substrate is being polished, to determine a polishing state of the region being polished. According to the present invention, a tension (tensile stress) applied to a portion (the clamp members of the edge portion polisher, the resilient member of the bevel portion polisher or the notch polisher) for pressing the polishing tape against the substrate while the substrate is being polished is detected by a strain gage or the like, and a change in the tension is analyzed by being compared with stored data to grasp the polishing state of the region being polished.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
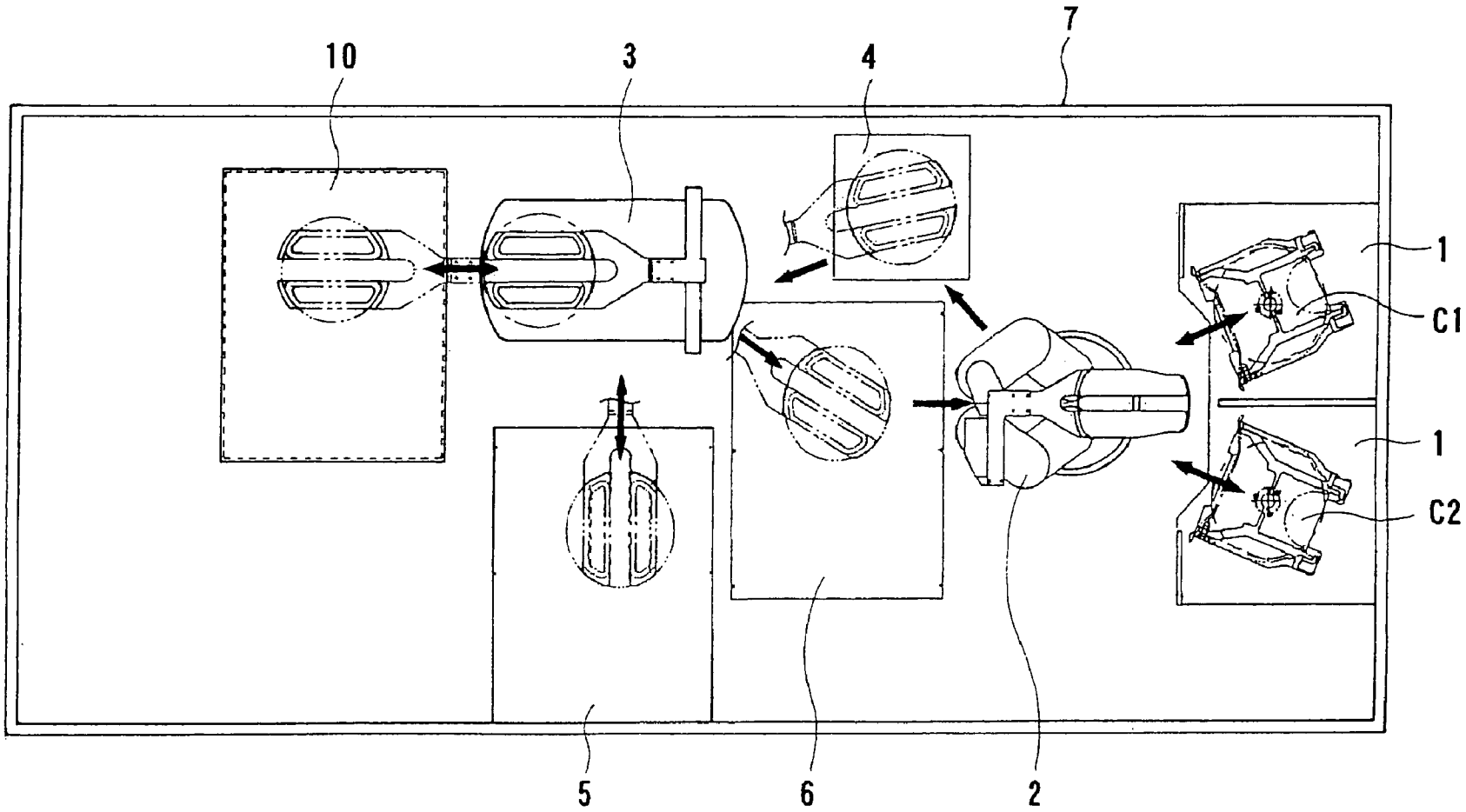
FIG. 1 is a plan view of an overall arrangement of a substrate processing apparatus according to the present invention.

A substrate processing apparatus according to preferred embodiments of the present invention will be described below with reference to the drawings. The substrate processing apparatus according to the present invention serves to polish a bevel portion, an edge portion, and a notch of a substrate such as a semiconductor wafer (Si wafer) to remove surface irregularities occurring on a peripheral portion, e.g., the bevel portion, the edge portion, and the notch, of the substrate, and films deposited as a contaminant on the peripheral portion of the substrate, thereafter clean the substrate, dry the substrate, and then deliver the substrate for a next process. Identical or corresponding parts are denoted by identical or corresponding reference numerals throughout views.

FIG. 1 shows in plan an overall arrangement of a substrate processing apparatus according to the present invention. As shown in FIG. 1, the substrate processing apparatus comprises a pair of loading/unloading stages 1 for placing thereon respective wafer cassettes C1, C2 which house a plurality of semiconductor wafers (substrates) therein, a first transfer robot 2 for transferring a dry semiconductor wafer, a second transfer robot 3 for transferring a wet semiconductor wafer, a temporary storage table 4 for placement of a semiconductor wafer which is to be processed or has been processed, a polishing unit 10 for polishing a peripheral edge portion of a semiconductor wafer, and a pair of cleaning units 5, 6 for cleaning a polished semiconductor wafer. The first transfer robot 2 transfers a semiconductor wafer between the wafer cassettes C1, C2 on the loading/unloading stages 1, the temporary storage table 4, and the cleaning unit 6. The second transfer robot 3 transfers a semiconductor wafer between the temporary storage table 4, the polishing unit 10, and the cleaning units 5, 6.

The polishing unit 10 has a primary cleaning machine for conducting a primary cleaning of a semiconductor wafer after the peripheral edge portion of the semiconductor wafer has been polished. The cleaning unit 5 serves as a secondary cleaning machine for conducting a secondary cleaning of a semiconductor wafer, and the cleaning unit 6 serves as a tertiary cleaning machine for conducting a tertiary cleaning of a semiconductor wafer.

The substrate processing apparatus shown in FIG. 1 is surrounded by a housing 7 which supports an air supply fan, a chemical filter, and a HEPA or ULPA filter on its ceiling. Air is supplied from the air supply fan and flows downwardly through the chemical filter and the HEPA or ULPA filter toward an air discharge port in a bottom of the housing. Thus, a downward flow of clean air is applied to surfaces of semiconductor wafers that are being processed by the substrate processing apparatus in order to prevent the semiconductor wafers from being contaminated when they are polished, cleaned, and transported. The substrate processing apparatus maintains such an air pressure gradient therein that the air pressure is progressively lower in order from the loading/unloading stages 1, the temporary storage table 4 and the cleaning unit 6, the cleaning unit 5 to the polishing unit 10 (the loading/unloading stage 1>the temporary storage table 4, the cleaning unit 6>the cleaning unit 5>the polishing unit 10). The substrate processing apparatus thus constructed can operate as a dry-in and dry-out type substrate edge polishing apparatus capable of performing a highly clean polishing process even if the substrate processing apparatus is installed in not only a clean room but also an ordinary environment in which dust management is not performed.

A polishing process performed by the substrate processing apparatus will be described below.

The wafer cassettes C1, C2 accommodating therein semiconductor wafers that have been processed in a CMP process or a Cu film forming process are transferred to the substrate processing apparatus by a cassette feeder (not shown), and placed on the loading/unloading stages 1. The first transfer robot 2 removes a semiconductor wafer from the wafer cassette C1 or C2 on loading/unloading stage 1, and places this removed semiconductor wafer on the temporary storage table 4. The second transfer robot 3 receives the semiconductor wafer from the temporary storage table 4, and delivers this received semiconductor wafer to the polishing unit 10. In the polishing unit 10, a bevel portion, an edge portion, and a notch of the semiconductor wafer are polished.

In the polishing unit 10, while the semiconductor wafer is being polished or after the semiconductor wafer is polished, a cleaning liquid such as water or a chemical liquid is supplied from one or more nozzles (not shown) disposed above the semiconductor wafer, to clean an upper surface of the semiconductor wafer (including the bevel portion), the edge portion, and the notch of the semiconductor wafer. The cleaning liquid is applied for a purpose of managing properties of material of the upper surface of the semiconductor wafer in the polishing unit 10, e.g., for a purpose of forming a uniform oxide film on the upper surface of the semiconductor wafer without causing surface property modifications such as non-uniform oxidization due to application of a chemical liquid. After the semiconductor wafer is polished, a sponge roller is pressed against a peripheral edge of the semiconductor wafer to scrub the peripheral edge of the semiconductor wafer. This cleaning process that is performed in the polishing unit 10 is referred to as a primary cleaning process.

The cleaning units 5, 6 perform secondary and tertiary cleaning processes, respectively. The semiconductor wafer that has been cleaned in the primary cleaning process by the polishing unit 10 is transferred to the cleaning unit 5 or 6 by the second transfer robot 3. The cleaning unit 5 cleans the semiconductor wafer in the secondary cleaning process, or the cleaning unit 6 cleans the semiconductor wafer in the tertiary cleaning process. Alternatively, the cleaning units 5, 6 clean the semiconductor wafer in the secondary and tertiary cleaning processes, respectively.

In the cleaning unit 5 or 6 where the semiconductor wafer is finally cleaned, the semiconductor wafer is dried. Thereafter, this dried semiconductor wafer is received by the first transfer robot 2. The first transfer robot 2 then returns the semiconductor wafer to one of the wafer cassettes C1, C2 on the loading/unloading stage 1.

In the secondary and tertiary cleaning processes, a contact-type cleaning using a pencil-shaped or roll-shaped PVA sponge and a noncontact-type cleaning using a cavitation jet or an ultrasonically vibrated liquid may be combined with each other.

A polishing end point of the polishing process performed in the polishing unit 10 may be managed based on polishing time. Alternatively, a light such as a laser beam or an LED light having a predetermined shape and a predetermined intensity may be applied to the semiconductor wafer in a direction normal to a device-formed surface of the semiconductor wafer by an optical device (not shown), and scattered light from the semiconductor wafer may be measured to measure irregularities on the bevel portion. Then, a polishing end point may be detected based on measured irregularities on the bevel portion. Specific embodiments for detecting a polishing end point will be described later on.

Structural details of the polishing unit 10 that are incorporated in the substrate processing apparatus will be described below with reference to FIGS. 2 through 15.

Figure 2:
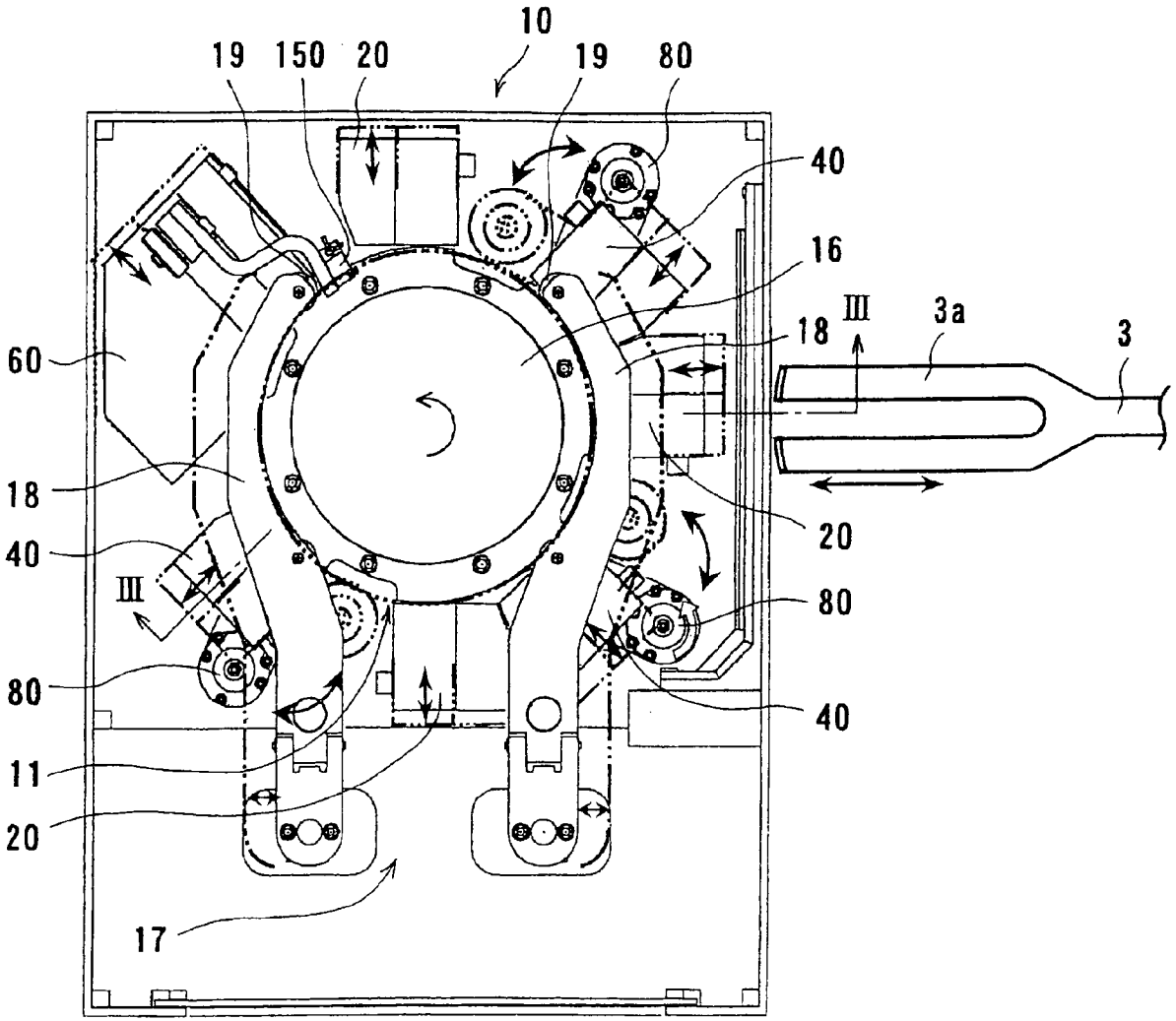
FIG. 2 is a plan view of an overall arrangement of a polishing unit of the substrate processing apparatus shown in FIG. 1.
Figure 3:
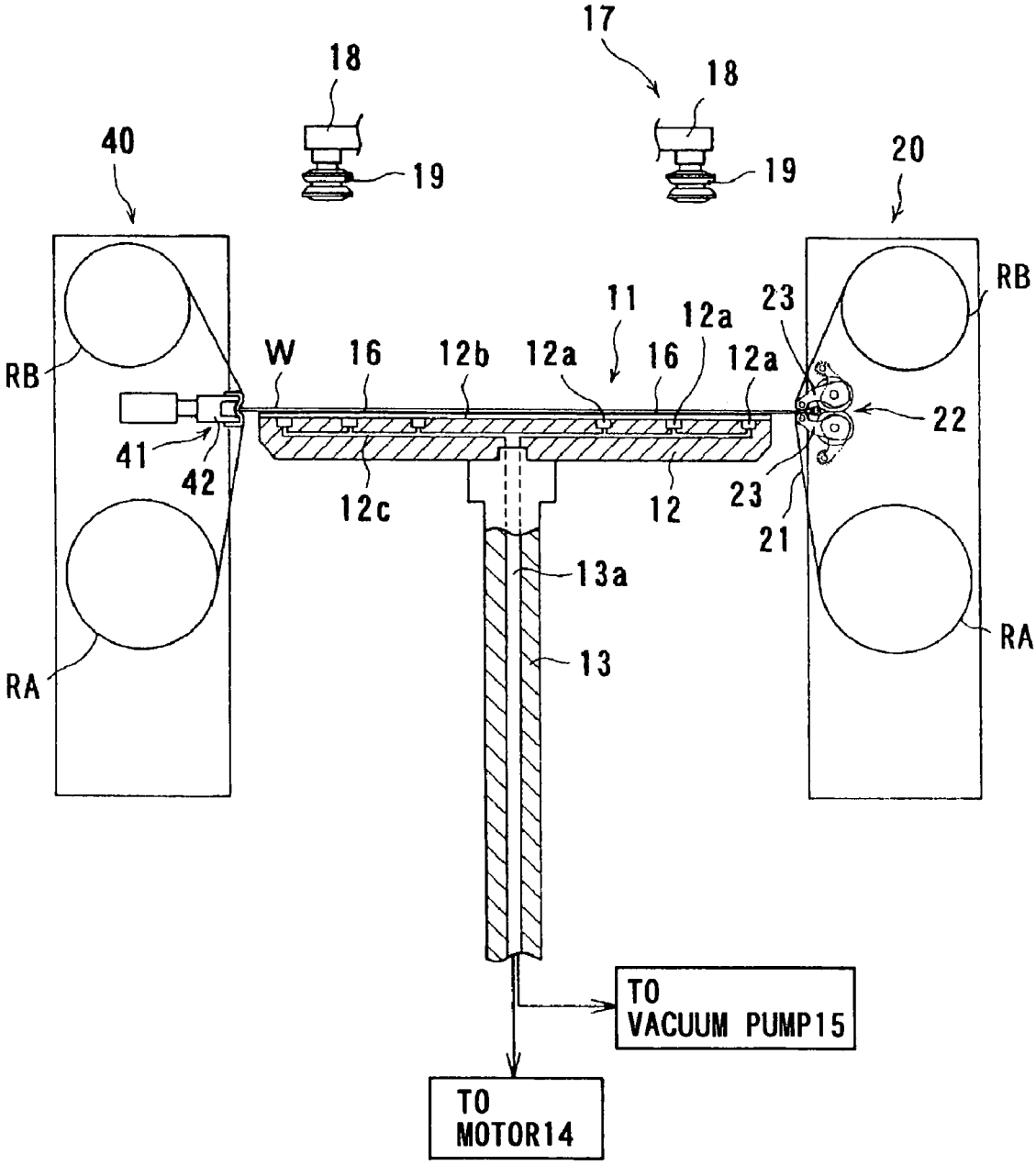
FIG. 3 is a cross-sectional view taken along line III—III of FIG. 2.

FIG. 2 shows in plan an overall arrangement of the polishing unit 10, and FIG. 3 is a cross-sectional view taken along line III—III of FIG. 2. As shown in FIGS. 2 and 3, the polishing unit 10 comprises a substrate holder 11 for attracting a reverse face of a semiconductor wafer W under vacuum to hold the semiconductor wafer W, a plurality of clamping polishers 20 for clamping upper and lower surfaces of an edge portion of the semiconductor wafer W through a polishing tape and polishing the edge portion with the polishing tape, a plurality of pushing polishers 40 for pressing a polishing tape against a bevel portion of the semiconductor wafer W and polishing the bevel portion with this polishing tape, and a notch polisher 60 for pressing a polishing tape against a notch of the semiconductor wafer W and polishing the notch with this polishing tape. The polishing unit 10 also has a plurality of cleaning devices 80 for conducting a primary cleaning of a polished semiconductor wafer W. As shown in FIG. 2, the polishing unit 10 has three clamping polishers 20 angularly spaced around the semiconductor wafer W, three pushing polishers 40 angularly spaced around the semiconductor wafer W, and three cleaning devices 80 angularly spaced around the semiconductor wafer W, and a single notch polisher 60.

As shown in FIG. 3, the substrate holder 11 comprises a substrate holding table 12 having vacuum attraction grooves for attracting the semiconductor wafer W under vacuum, and a support shaft 13 which supports the substrate holding table 12 on its upper end. A motor 14 is connected to a lower end of the support shaft 13 for rotating the support shaft 13 and the substrate holding table 12 integrally. The substrate holding table 12 has a plurality of concentric grooves 12*a* that are defined and open in its upper surface, and a plurality of criss-crossing grooves 12*b* defined in the upper surface and extending across the concentric grooves 12*a*. The concentric grooves 12*a* are connected to a communication passage 12*c* defined in the substrate holding table 12. The communication passage 12*c* communicates with a communication passage 13*a* defined in the support shaft 13. The communication passage 13*a* is connected to a vacuum pump 15.

A backing film 16 made of synthetic resin is attached to the upper surface of the substrate holding table 12 so as to cover the concentric grooves 12*a* and the criss-crossing grooves 12*b*. The backing film 16 has a number of through-holes (not shown) defined therein and having a small diameter, and the through-holes communicate with the concentric grooves 12*a* and the criss-crossing grooves 12*b* in the substrate holding table 12. Therefore, when the vacuum pump 15 is operated, a vacuum is developed in the through-holes of the backing film 16 through the communication passage 13*a* of the support shaft 13, the communication passage 12*c* of the substrate holding table 12, the concentric grooves 12*a*, and the criss-crossing grooves 12*b*. Thus, the semiconductor wafer W is attracted to an upper surface of the backing film 16 under vacuum.

The substrate holding table 12 and the support shaft 13 are connected to a lifting/lowering mechanism (not shown). For receiving or delivering a semiconductor wafer W, the substrate holding table 12 and the support shaft 13 are lifted by the lifting/lowering mechanism, and the substrate holding table 12 receives the semiconductor wafer W from a transferring mechanism (described later on) or delivers the semiconductor wafer W to the transferring mechanism.

In the substrate holder 11 having the above structure, after a semiconductor wafer W is received from the transferring mechanism, the substrate holding table 12 and the support shaft 13 are lowered by the lifting/lowering mechanism. Then, the vacuum pump 15 is actuated to attract the semiconductor wafer W placed on the backing film 16 on the upper surface of the substrate holding table 12 under vacuum. Thereafter, the motor 14 is energized to rotate the substrate holding table 12 and thus the semiconductor wafer W at a predetermined rotational speed about a center of the semiconductor wafer W.

As shown in FIGS. 2 and 3, a centering and transferring mechanism 17 is disposed above the substrate holder 11. The centering and transferring mechanism 17 has a pair of arms 18 each having a plurality of rollers 19. Each of the rollers has a concave surface complementary in cross section to the bevel portion of the semiconductor wafer W. The arms 18 are movable between a closed position shown by solid lines and an open position shown by imaginary lines. The arms 18 grip the semiconductor wafer W with the rollers 19 when the arms 18 are in the closed position, and release the semiconductor wafer W when the arms 18 are in the open position. When the arms 18 grip the semiconductor wafer W, positioning of the semiconductor wafer W is conducted, i.e., centering of the semiconductor wafer W is conducted.

In the centering and transferring mechanism 17 having the above structure, the semiconductor wafer W is transferred from a hand 3*a* of the second transfer robot 3 to the centering and transferring mechanism 17, and the arms 18 are moved to the closed position to grip and center the semiconductor wafer W. Thereafter, the substrate holding table 12 and the support shaft 13 are lifted to attract the semiconductor wafer W held by the centering and transferring mechanism 17 under vacuum. At the same time that the substrate holding table 12 attracts the semiconductor wafer W under vacuum, the arms 18 are opened to release the semiconductor wafer W. Thus, the semiconductor wafer W is delivered from the centering and transferring mechanism 17 to the substrate holder 11. Thereafter, the substrate holding table 12 which holds the semiconductor wafer W is lowered to a position shown in FIG. 3.

Structural details of the clamping polishers 20 will be described below with reference to FIGS. 4 through 6.

Figure 4:
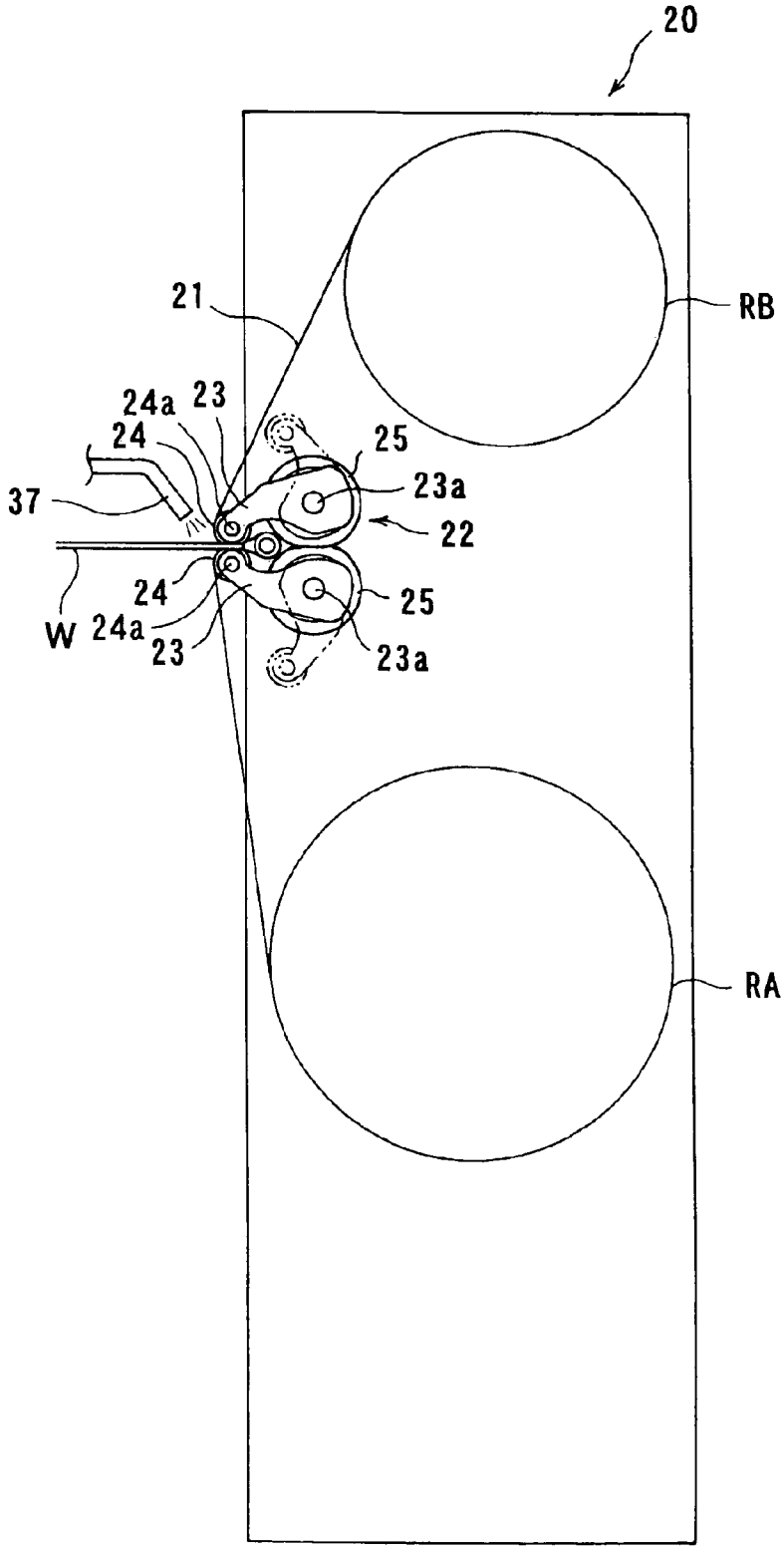
FIG. 4 is a side elevational view of an overall arrangement of a clamping polisher.
Figure 5A:
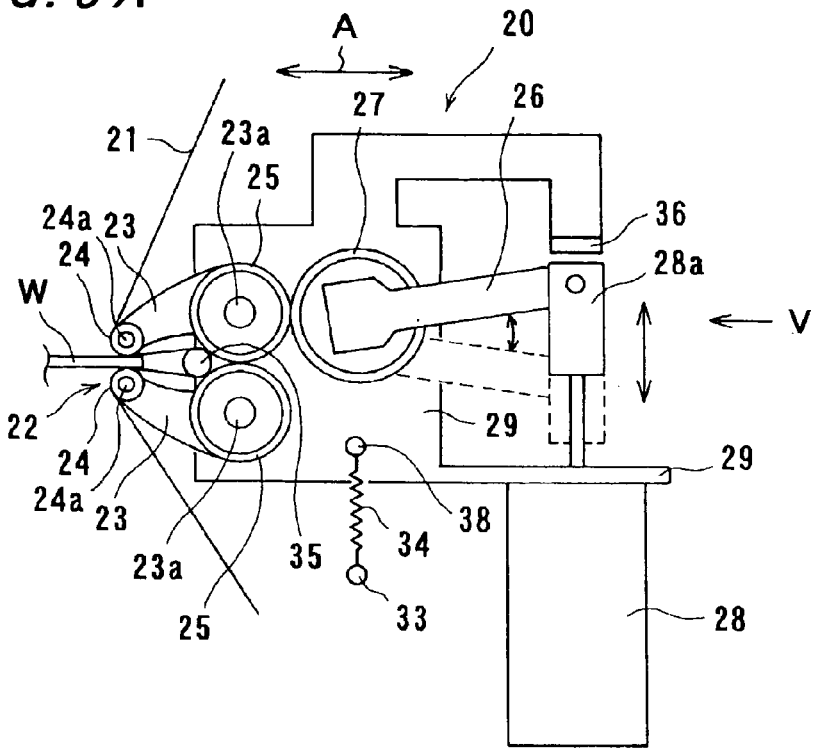
FIGS. 5A and 5B are views showing an actuating mechanism of the clamping polisher, with FIG. 5A being a side elevational view of the actuating mechanism, and FIG. 5B being a view as viewed in a direction indicated by arrow V in FIG. 5A.
Figure 5B:
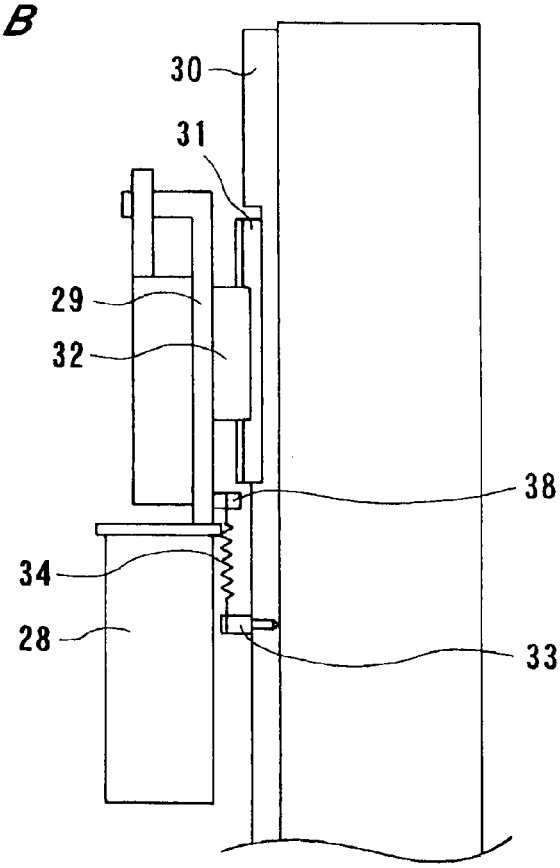

FIG. 4 shows in side elevation an overall arrangement of each of the clamping polishers 20. FIGS. 5A and 5B show an actuating mechanism of each clamping polisher 20, with FIG. 5A being a side elevational view of the actuating mechanism and FIG. 5B being a view as viewed in the direction indicated by arrow V in FIG. 5A. FIG. 6 is an enlarged view showing a manner in which the clamping polisher 20 operates. The clamping polisher 20 clamps the upper and lower surfaces of an edge portion of the semiconductor wafer W through a polishing tape and polishes the edge portion with the polishing tape. The clamping polisher 20 serves as an edge-portion polisher. As shown in FIGS. 4 and 5A, the clamping polisher 20 has a polishing head 22 for clamping the upper and lower surfaces of the edge portion of the semiconductor wafer W through a polishing tape 21. The polishing head 22 comprises a pair of clamp arms 23 swingable about respective support shafts 23*a* so as to move toward and away from each other, a pair of roller pressers 24 rotatably mounted on respective distal ends of the clamp arms 23, and a pair of upper and lower gears 25 fixedly mounted on respective proximal ends of the clamp arms 23. The roller pressers 24 comprise respective cylindrical shafts 24*a* and respective resilient rolls made of natural rubber or the like disposed around the respective cylindrical shafts 24*a*. The upper and lower gears 25 have equal pitch circles and equal numbers of teeth, and are held in mesh with each other. The clamp arms 23 have the same length and shape.

In the polishing head 22, when the clamp arms 23 are closed, i.e., angularly displaced toward each other, the roller pressers 24 press the polishing tape 21 against the upper and lower surfaces of the edge portion of the semiconductor wafer W. A roller guide 35 made of PVC (polyvinyl chloride) for guiding the polishing tape 21 is rotatably supported on a fixed frame 30, and the roller guide 35 is located radially outwardly of the semiconductor wafer W between the clamp arms 23.

One of the gears 25, i.e. the upper gear 25 is held in mesh with a gear 27 fixed to a distal end of a swing arm 26. A proximal end of the swing arm 26 is mounted on a rod 28*a* of an air cylinder 28.

As shown in FIG. 5B, the polishing head 22, the swing arm 26 with the gear 27, and the air cylinder 28 are supported on a support frame 29. The fixed frame 30 is fixed to a stationary part such as a base of the polishing unit 10. A slider 32 is slidably mounted on a linear guide rail 31 fixedly mounted on the fixed frame 30. The support frame 29 is fixed to the slider 32. A pin 33 is fixed to the fixed frame 30, and a pin 38 is fixed to the support frame 29. A tension coiled spring 34 is provided between the pins 33 and 38. Thus, the polishing head 22, and the swing arm 26, the gear 27, and the air cylinder 28, which jointly serve as a mechanism for opening and closing the polishing head 22, are in a floating condition with respect to the fixed frame 30, and the polishing head 22 is vertically movable in a certain range. The slider 32 is normally biased to move downwardly by the tension coiled spring 34. A stopper (not shown) is provided to limit the slider 32 against downward sliding movement beyond a certain position for preventing the slider 32 from being dislodged from the linear guide rail 31.

The air cylinder 28 has its stroke limited by a stopper 36 fixed to the support frame 29. Specifically, when the rod 28*a* of the air cylinder 28 projects upwardly, a distal end of the rod 28*a* contacts the stopper 36, thus preventing the rod 28*a* from projecting further upwardly.

The polishing tape 21 is housed in a cassette tape cartridge (not shown), and is supplied from a supply reel RB in the cassette tape cartridge and wound under a given tension by a takeup reel RA in the cassette tape cartridge. The polishing tape 21 that extends from the supply reel RB to the takeup reel RA is trained around upper roller presser 24, the roller guide 35, and lower roller presser 24, such that the polishing tape 21 extending around the upper roller presser 24 will be pressed against the upper surface of the edge portion of the semiconductor wafer W, and the polishing tape 21 extending around the lower roller presser 24 will be pressed against the lower surface of the edge portion of the semiconductor wafer W.

The clamping polisher 20 thus constructed operates as follows: When the air cylinder 28 operates to project the rod 28*a*, the rod 28*a* is displaced to come into contact with the stopper 36. The swing arm 26 is swung upwardly to rotate the gear 27 counterclockwise. As a result, the upper gear 25 held in mesh with the gear 27 rotates clockwise, and the lower gear 25 held in mesh with the upper gear 25 rotates counterclockwise. The clamp arms 23 of the polishing head 22 are swung to respective positions shown by imaginary lines of FIGS. 4 and 6, and become in an open state. When the air cylinder 28 operates to retract the rod 28*a*, the swing arm 26 is swung downwardly to rotate the gear 27 clockwise. As a result, the upper gear 25 held in mesh with the gear 27 rotates counterclockwise, and the lower gear 25 held in mesh with the upper gear 25 rotates clockwise. The clamp arms 23 of the polishing head 22 are swung to respective positions shown by solid lines of FIGS. 4 and 6, and become in a closed state. The roller pressers 24 press the polishing tape 21 against the upper and lower surfaces of the edge portion of the semiconductor wafer W under equal pressing forces. In this case, when pressure of compressed air supplied to the air cylinder 28 is regulated, a clamping force of the clamp arms 23 is adjusted, and hence the pressing force of the roller pressers 24 for pressing the polishing tape 21 against the upper and lower surfaces of the edge portion of the semiconductor wafer W is also adjusted.

Figure 6:
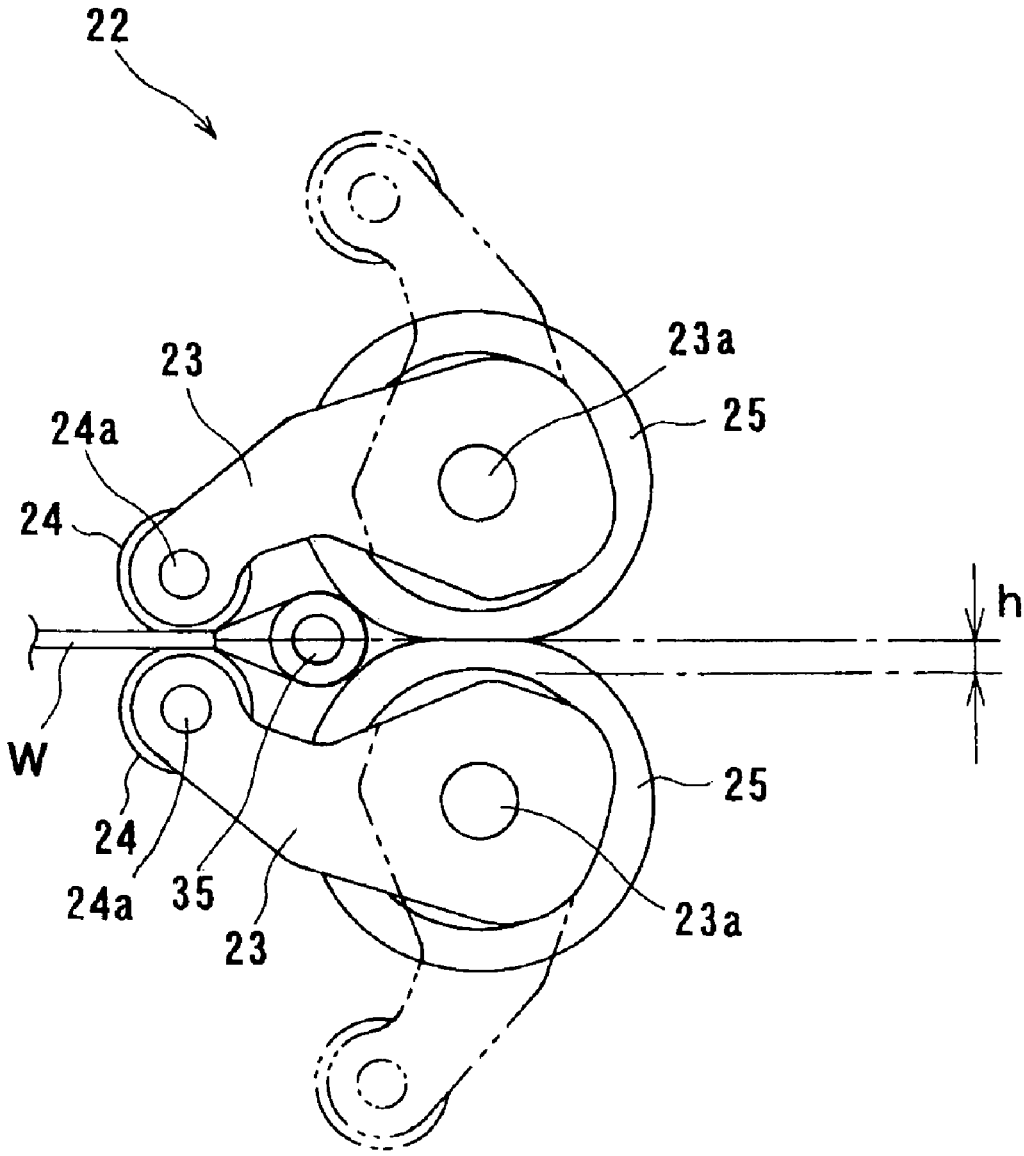
FIG. 6 is an enlarged view showing a manner in which the clamping polisher operates.

While the clamp arms 23 are clamping the upper and lower surfaces of the edge portion of the semiconductor wafer W through the polishing tape 21, the polishing head 22 floats by the floating mechanism in such a manner that a center of the polishing head 22 is lifted from a position before clamping the semiconductor wafer W to a position after clamping the semiconductor wafer W, by a slight distance "h" (which is about 1 mm in the present embodiment) as shown in FIG. 6. At this time, the semiconductor wafer W is attracted under vacuum to the substrate holding table 12 of the substrate holder 11. Since the substrate holding table 12 is rotated at a predetermined speed by the motor 14, the upper and lower surfaces of the edge portion of the semiconductor wafer W are held in sliding contact with the polishing tape 21 that is held at rest, thereby polishing the edge portion of the semiconductor wafer W. A pressure for pressing the polishing tape 21 against the edge portion of the semiconductor wafer W can be adjusted by regulating pressure of compressed air that is supplied to the air cylinder 28. For example, the polishing tape 21 is pressed against the edge portion of the semiconductor wafer W under a pressure of about 98 kPa. In this manner, the edge portion which is about several mm wide on a device-formed surface of the semiconductor wafer W can be polished. A width of the edge portion to be polished can be adjusted by moving the polishing head 22 toward or away from the center of the semiconductor wafer W with a displacing mechanism (not shown), i.e., selectively in directions indicated by arrow A in FIG. 5A. If the width of the edge portion to be polished is large, then the semiconductor wafer W may be polished while the polishing head 22 is being moved or swung in a radial direction by the displacing mechanism. At this time, as shown in FIG. 4, a chemical liquid or pure water is supplied from a chemical liquid supply nozzle 37 to an area where the edge portion of the semiconductor wafer W and the polishing tape 21 contact each other, thereby polishing the edge portion of the semiconductor wafer W in a wet environment. A portion of the polishing tape 21 which has been worn by polishing the edge portion of the semiconductor wafer W is displaced toward the takeup reel RA before a polishing rate is significantly lowered, thereby bringing a fresh portion of the polishing tape 21 into contact with the semiconductor wafer W. If the lower surface of the edge portion of the semiconductor wafer W does not need to be polished or needs to be polished slightly, then the polishing tape 21 may be fed such that a fresh unused portion of the polishing tape 21 is held in contact with the upper surface of the edge portion and a used worn portion of the polishing tape 21 is held in contact with the lower surface of the edge portion. Alternatively, when the polishing tape 21 is worn, the polishing tape 21 may be fed such that a fresh unused portion of the polishing tape 21 is held in contact with both the upper and lower surfaces of the edge portion.

The polishing tape 21 may be displaced in sliding contact with the semiconductor wafer W to polish the semiconductor wafer W. Further, while the semiconductor wafer W is being polished by rotation of the semiconductor wafer W, the polishing tape 21 may be fed at a predetermined speed in a reciprocating manner or a continuous manner between the supply reel RB and the takeup reel RA, thereby increasing the polishing rate due to a combination of the sliding motion of the polishing tape 21 in a direction of thickness of the semiconductor wafer W and a rotational motion of the semiconductor wafer W.

The polishing tape 21 may comprise a polishing tape with abrasive particles of diamond or SiC bonded to one side of the polishing tape. A surface of the polishing tape having the abrasive particles serves as a polishing surface. The abrasive particles bonded to the polishing tape have a particle size selected depending on a type of the semiconductor wafer W to be polished and a required performance of the clamping polisher 20. For example, an abrasive particle of diamond having a particle size of #4000 to #12000 or an abrasive particle of SiC having a particle size of #4000 to #10000 may be used.

Each of the clamping polishers 20 polishes the semiconductor wafer W by holding and rotating the semiconductor wafer W with the substrate holding table 12 and clamping the upper and lower surfaces of the edge portion of the semiconductor wafer W through the polishing tape 21 by the polishing head 22. According to the clamping polisher 20 of the present invention, the polishing tape 21 is pressed against the upper and lower surfaces of the edge portion of the semiconductor wafer W while the clamp arms 23 of the polishing head 22 clamp the semiconductor wafer W through the polishing tape 21. In this case, the polishing tape 21 may be sandwiched and pressed against the edge portion of the semiconductor wafer W by flat surfaces or roller surfaces. Since the polishing tape 21 is pressed against the edge portion of the semiconductor wafer W by the air cylinder 28 or the like, the pressure for pressing the polishing tape 21 against the edge portion of the semiconductor wafer W can be adjusted to a desired value.

According to the present invention, the clamp arms 23 can be moved in a radial direction of the semiconductor wafer W in order to adjust a radial position of the edge portion, to be polished, of the semiconductor wafer W. According to the present invention, a position of the edge portion to be polished can be freely adjusted, and a length of the edge portion to be polished can be freely adjusted.

According to the present invention, the roller guide 35 for guiding the polishing tape 21 is disposed radially outwardly of the semiconductor wafer W between the clamp arms 23. The roller guide 35 serves to guide the polishing tape 21 from one of the clamp arms 23 toward the other clamp arm 23. The polishing tape 21 is sandwiched and pressed against the edge portion of the semiconductor wafer W by the clamp arms 23, and the polishing tape 21 is guided by the roller guide 35 radially outwardly of a position where the polishing tape 21 is sandwiched and pressed against the edge portion of the semiconductor wafer W. In this manner, since the polishing tape 21 is once spaced by the roller guide 35 from a contact portion where the polishing tape 21 contacts the semiconductor wafer W, the polishing tape 21 is prevented from being twisted, and the upper and lower surfaces of the edge portion of the semiconductor wafer W can be polished by only polishing tape 21.

According to the present invention, the clamp arms 23 serving as a clamping mechanism for clamping the semiconductor wafer W, and the swing arm 26 serving as a mechanism for opening and closing the clamp arms 23 are vertically movable. Since the clamp arms 23 and the swing arm 26 are vertically movable, when the clamp arms 23 clamp the semiconductor wafer W, the semiconductor wafer W and the clamp arms 23 are automatically aligned relatively with each other in a vertical direction. Therefore, the clamp arms 23 and the swing arm 26 that are vertically movable provide a vertically aligning mechanism for automatically adjusting a position where the polishing tape 21 is clamped.

Structural details of the pushing polishers 40 will be described below with reference to FIGS. 7 through 9A and 9B.

Figure 7:
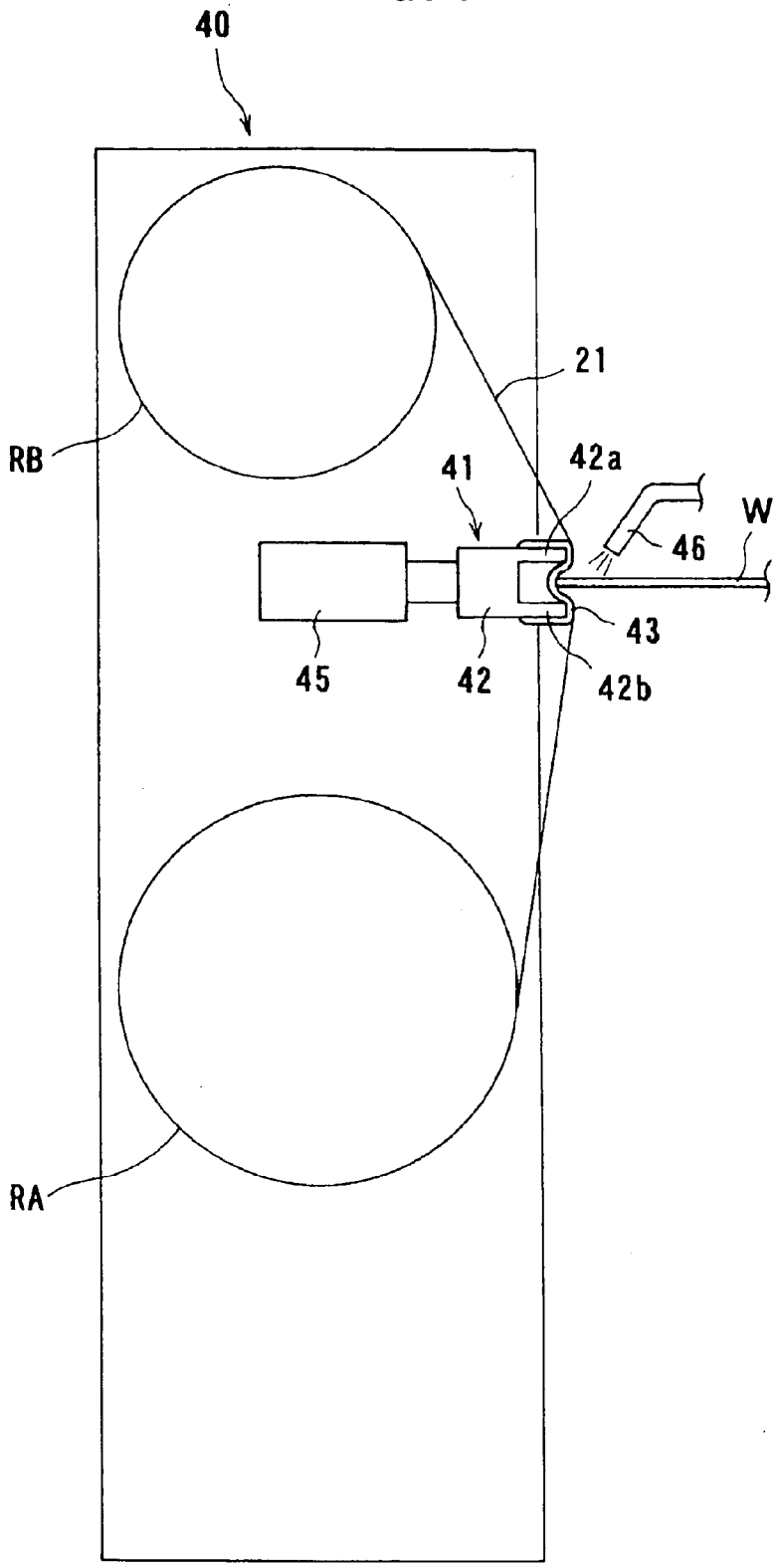
FIG. 7 is a side elevational view of an overall arrangement of a pushing polisher.
Figure 8:
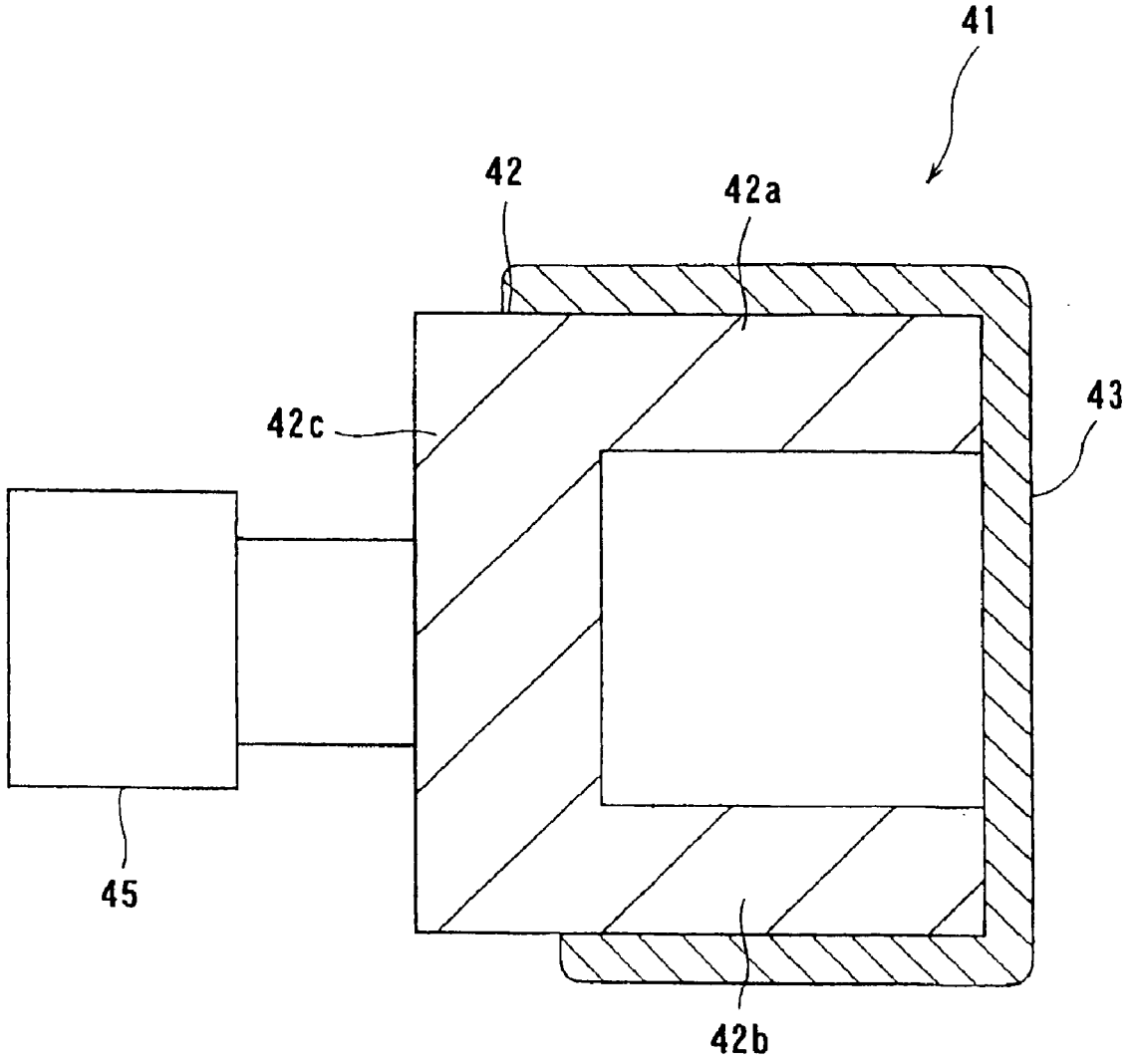
FIG. 8 is an enlarged cross-sectional view of the pushing polisher.
Figure 9A:
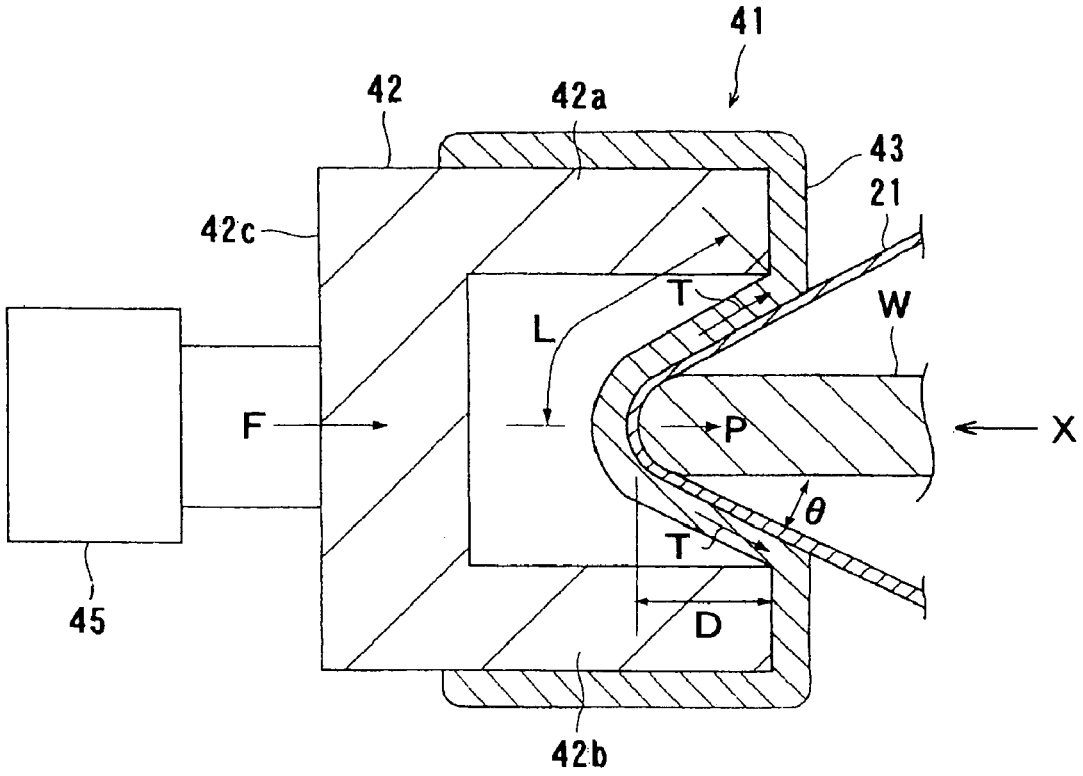
FIG. 9A is an enlarged cross-sectional view showing a manner in which the pushing polisher operates.
Figure 9B:
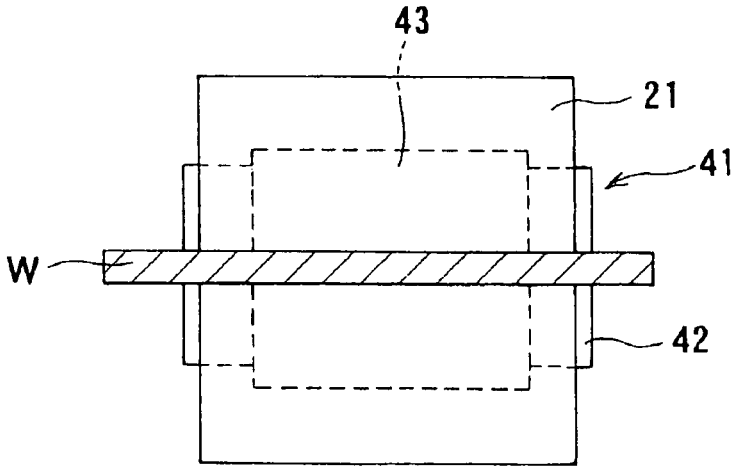
FIG. 9B is a view as viewed in a direction indicated by arrow X in FIG. 9A.

FIG. 7 shows in side elevation an overall arrangement of pushing polisher 40. FIG. 8 shows the pushing polisher 40 in enlarged cross section. FIG. 9A is an enlarged cross-sectional view showing a manner in which the pushing polisher 40 operates, and FIG. 9B is a view as viewed in a direction indicated by arrow X in FIG. 9A. The pushing polisher 40 serves to press a polishing tape against a bevel portion of the semiconductor wafer W to polish the bevel portion. The pushing polisher 40 serves as a bevel-portion polisher. As shown in FIGS. 7 and 8, the pushing polisher 40 has a polishing head 41 for pressing a polishing tape 21 against the bevel portion of the semiconductor wafer W to polish the bevel portion. The polishing head 41 comprises a support 42 having two vertically spaced projections 42*a*, 42*b*, and a resilient member 43 made of elastic rubber or the like that extends between distal ends of the projections 42*a*, 42*b*. The polishing tape 21 is positioned over an outer surface of the resilient member 43 which faces the bevel portion of the semiconductor wafer W.

The polishing head 41 is movable in a radial direction of the semiconductor wafer W by a displacing mechanism (not shown). The support 42 of the polishing head 41 has a base portion 42*c* connected to an air cylinder 45. When the air cylinder 45 operates to move the support 42 toward the center of the semiconductor wafer W, the polishing tape 21 is pressed against the bevel portion of the semiconductor wafer W by the resilient member 43, as shown in FIG. 9A. Details of a process of actuating the air cylinder 45 will be described later on. The polishing head 41 may incorporate a mechanism for changing a vertical distance between the projections 42*a* and 42*b*.

The polishing tape 21 is housed in a cassette tape cartridge (not shown), and is supplied from a supply reel RB in the cassette tape cartridge and wound under a given tension by a takeup reel RA in the cassette tape cartridge.

The pushing polisher 40 thus constructed operates as follows: When the air cylinder 45 operates to move the support 42 of the polishing head 41 toward the center of the semiconductor wafer W, the polishing tape 21 is pressed against the bevel portion of the semiconductor wafer W by the resilient member 43, as shown in FIG. 9A. The bevel portion of the semiconductor wafer W is vertically positioned between the projections 42*a* and 42*b*, and the resilient member 43 is pressed against a reverse side of the polishing tape 21 between the projections 42*a* and 42*b*. Therefore, the resilient member 43 is stretched between the projections 42*a* and 42*b*, thus generating a tension T (see FIG. 9A). A pressure P is applied from the polishing tape 21 to the bevel portion of the semiconductor wafer W by the tension T of the resilient member 43. A magnitude of the pressure P is expressed by $P=T/(\rho w)$, where $\rho$ represents a radius of curvature of a cross-sectional shape of the bevel portion and w represents the width of the polishing tape 21, on condition that the polishing tape 21 has a thickness that is sufficiently smaller than the radius of curvature p. At this time, because the semiconductor wafer W is attracted under vacuum to the substrate holding table 12 of the substrate holder 11 and the substrate holding table 12 is rotated at a predetermined speed by the motor 14, the bevel portion of the semiconductor wafer W is held in sliding contact with the polishing tape 21 that is held at rest, thereby polishing the bevel portion of the semiconductor wafer W. A pressure for pressing the polishing tape 21 against the bevel portion of the semiconductor wafer W can be adjusted by regulating pressure of compressed air that is supplied to the air cylinder 45. For example, the polishing tape 21 is pressed against the bevel portion of the semiconductor wafer W under a pressure of about 98 kPa. At this time, as shown in FIG. 7, a chemical liquid or pure water is supplied from a chemical liquid supply nozzle 46 to an area where the bevel portion of the semiconductor wafer W and the polishing tape 21 contact each other, thereby polishing the bevel portion of the semiconductor wafer W in a wet environment. A portion of the polishing tape 21 which has been worn by polishing the bevel portion of the semiconductor wafer W is displaced toward the takeup reel RA before a polishing rate is significantly lowered, thereby bringing a fresh portion of the polishing tape 21 into contact with the semiconductor wafer W.

In this manner, the bevel portion of the semiconductor wafer W is polished by the polishing tape 21. When the resilient member 43 is deteriorated due to aging, its resiliency may be lost or the resilient member 43 may be plastically deformed into an increased length, resulting in a lowering of the tension of the resilient member 43 while the bevel portion of the semiconductor wafer W is being polished. If the tension of the resilient member 43 is lowered, a polishing load on the bevel portion of the semiconductor wafer W is reduced. Thus, the polishing rate is lowered, and hence polishing efficiency is lowered. Furthermore, since the polishing rate is changed by a lowering of the tension of the resilient member 43, a desired polishing profile of the bevel portion of the semiconductor wafer W cannot be obtained.

Deterioration of the resilient member 43 refers to an increase in a natural length of the resilient member 43 due to plastic deformation and a lowering of its Young's modulus. When stresses due to the tension are built up in the resilient member 43, the resilient member 43 is subjected to plastic deformation though the resilient member 43 is made of a resilient material, and a length of the resilient member 43 when the resilient member 43 is free of tension, i.e., the natural length, is increased. It has been found that when stresses due to tension are built up in the resilient member 43, the Young's modulus of the resilient member 43 is slightly lowered.

The deterioration of the resilient member 43 can be improved to some extent by selecting a resilient member 43 made of a material that is less liable to deteriorate, or increasing the thickness of the resilient member 43 to reduce tension that is applied thereto per unit area. However, it is impossible to fully eliminate deterioration of the resilient member 43.

Therefore, when the semiconductor wafer W is polished with a constant distance D (see FIG. 9A) by which the polishing tape 21 and the resilient member 43 are pushed in (this process will hereinafter be referred to as "constant position process"), the following problems arise: The constant position process is a process for determining, in advance, a position where the resilient member 43 can press the polishing tape 21 under a predetermined force, and moving the polishing head 41 to this determined position to polish the semiconductor wafer W. According to the constant position process, a predetermined tension is initially applied to the resilient member 43, but is then gradually reduced with time because of the deterioration of the resilient member 43 as referred to above. Therefore, the polishing rate is gradually reduced with time.

It has been found that if the resilient member 43 is made of natural rubber having a Young's modulus of 0.6 MPa and a cross-sectional area of 13 $mm^2$, then the tension acting on the resilient member 43 is reduced by 10% when the resilient member 43 has been used for a cumulative time of 10 hours. Therefore, from a time when the cumulative time exceeds 10 hours, needle-like projections formed on the bevel portion cannot fully be removed in a rough polishing process for one minute, and hence processing time needs to be increased.

In view of the above problems, according to the present embodiment, the air cylinder 45 is used to cause the resilient member 43 to press the polishing tape 21 under a constant force F at all times (this process will hereinafter be referred to as "constant force process"). Specifically, according to the constant force process, the air cylinder 45 presses the support 42 and the resilient member 43 to keep a pressing force applied to the polishing tape 21 during polishing constant. Even if the resilient member 43 is elongated due to deterioration, the air cylinder 45 presses the support 42 and the resilient member 43 by a distance commensurate with elongation of the resilient member 43, thereby preventing the pressure applied from the polishing tape 21 to the bevel portion from being changed. Accordingly, the polishing rate of the bevel portion by the polishing tape 21 is kept constant regardless of the deterioration of the resilient member 43, and changes in the tension acting on the resilient member 43 can be neglected, thus stably polishing the bevel portion of the semiconductor wafer W.

According to the present embodiment, the polishing tape 21 comprises a thin-film polishing tape. Therefore, the polishing tape 21 is prevented from being bent sharply over the bevel portion of the semiconductor wafer W. Since the polishing tape 21 is curved exactly along a curved shape of the bevel portion of the semiconductor wafer W, the polishing tape 21 can uniformly polish the bevel portion of the semiconductor wafer W. In the present embodiment, because the polishing tape 21 comprises a thin-film polishing tape, the polishing tape 21 is curved exactly along the curved shape of the bevel portion of the semiconductor wafer W. However, the same advantage can be obtained by using a polishing tape 21 made of a material which is highly flexible.

According to the above process in which the resilient member 43 presses the polishing tape 21 against the semiconductor wafer W, because the pressure P applied from the polishing tape 21 to the bevel portion of the semiconductor wafer W is represented by $P=T/(\rho w)$, the pressure applied to the bevel portion is made uniform if the bevel portion has a fully round cross-sectional shape. When the resilient member 43 thus presses the polishing tape 21 against the semiconductor wafer W, a portion of the polishing tape 21 which contributes to a polishing action is expanded to increase the polishing rate and reduce fluctuations in the pressure on the contact surface of the polishing tape 21 for thereby uniformizing stock removal from the semiconductor wafer W.

According to the present embodiment, as shown in FIG. 9B, a width of the polishing head 41 is greater than a width of the polishing tape 21. With this width selection, when the polishing head 41 is pressed against the semiconductor wafer W, the polishing tape 21 is confined in its entirety without slack or play. Therefore, the polishing tape 21 can polish the semiconductor wafer W without damaging a surface of the semiconductor wafer W. Since a relative speed between the polishing tape 21 and the semiconductor wafer W, which is required to polish the semiconductor wafer W, is produced by rotation of the semiconductor wafer W itself, the polishing tape 21 tends to be carried in a direction in which the semiconductor wafer W rotates. However, inasmuch as the width of the polishing head 41 is greater than the width of the polishing tape 21, a tape width required to polish the semiconductor wafer W remains unchanged even when the polishing tape 21 is carried in the direction in which the semiconductor wafer W rotates, and hence a stable polishing rate can be achieved.

Figure 10:
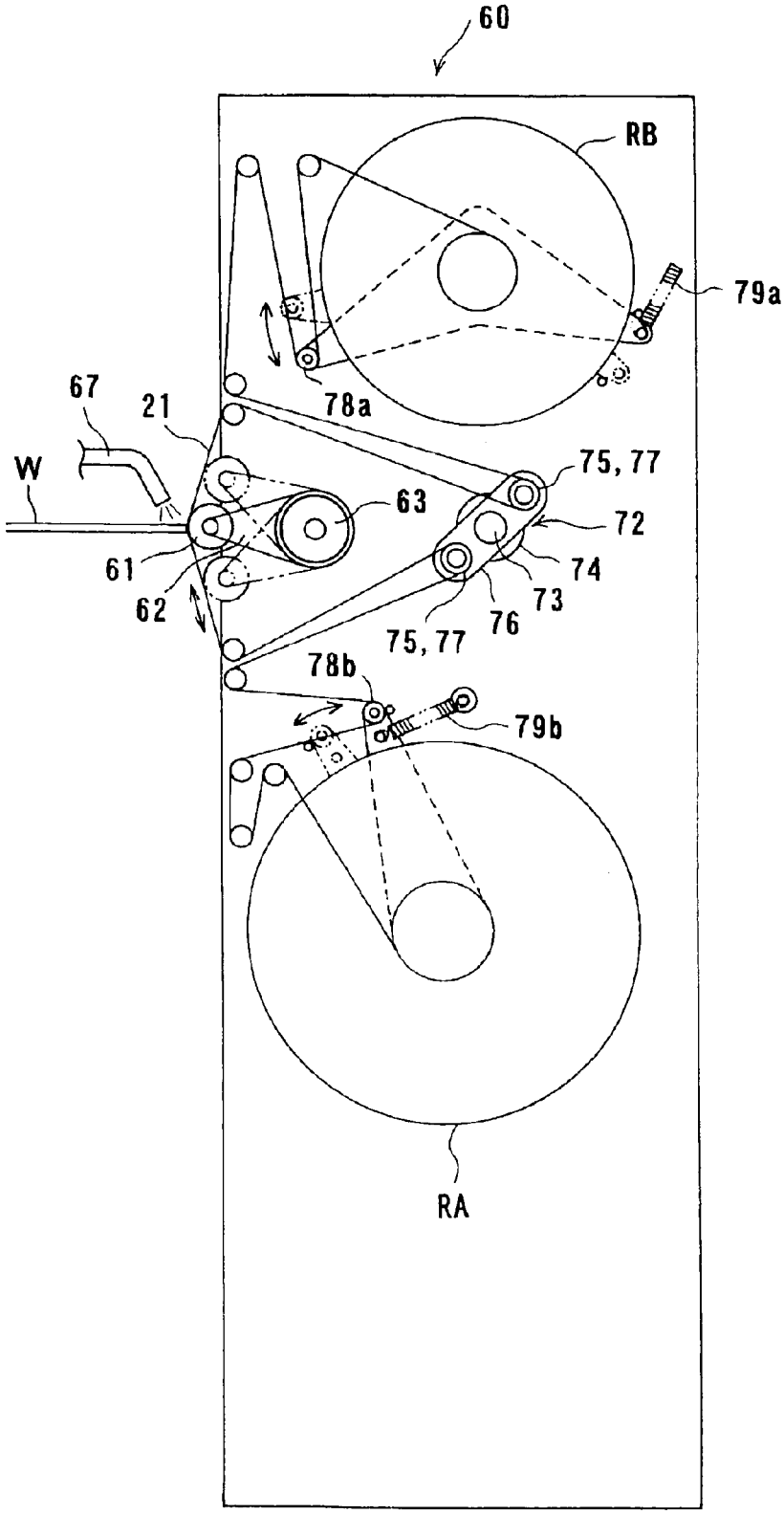
FIG. 10 is a side elevational view of an overall arrangement of a notch polisher.
Figure 11:
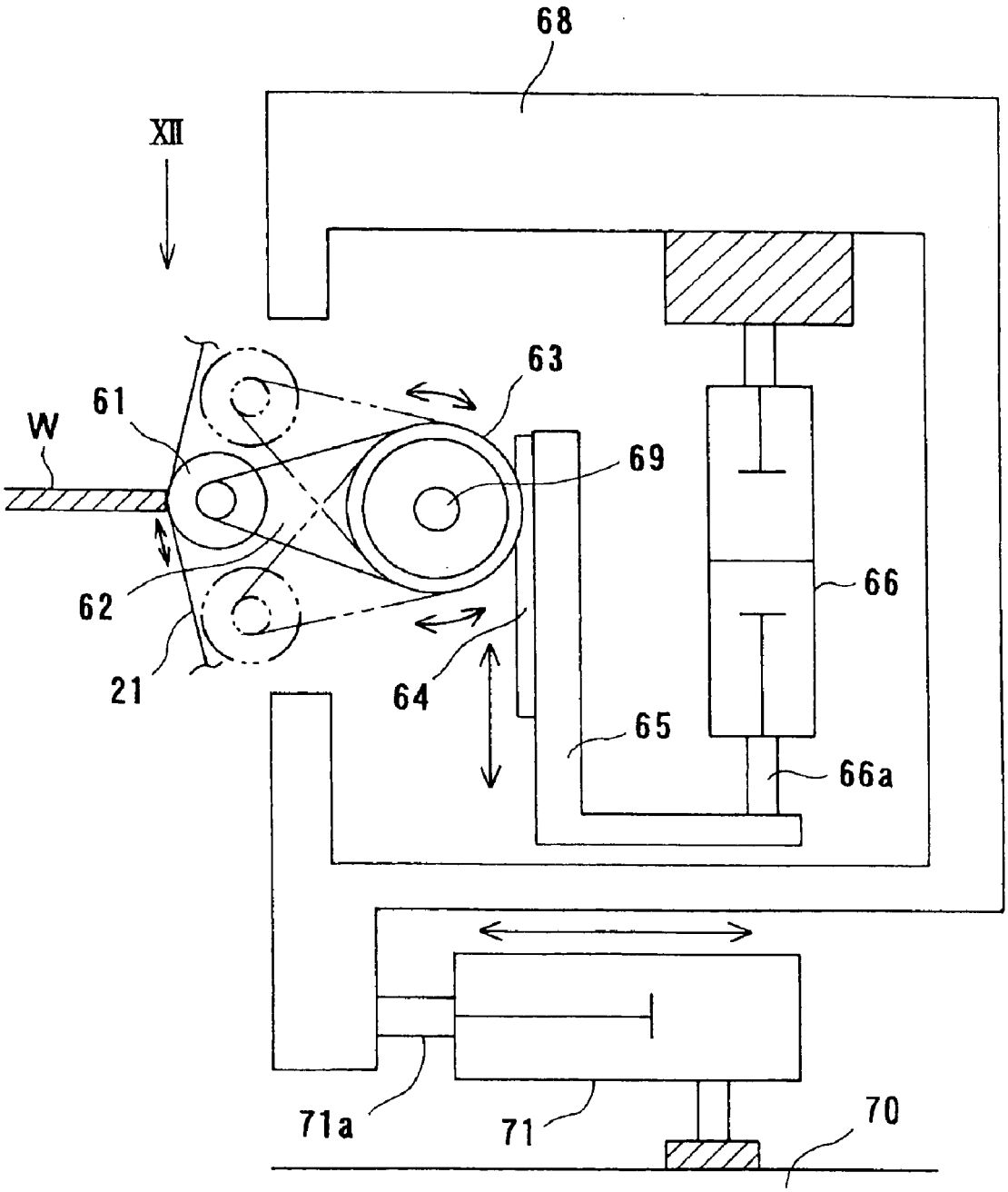
FIG. 11 is a side elevational view of an actuating mechanism of the notch polisher.
Figure 12A:
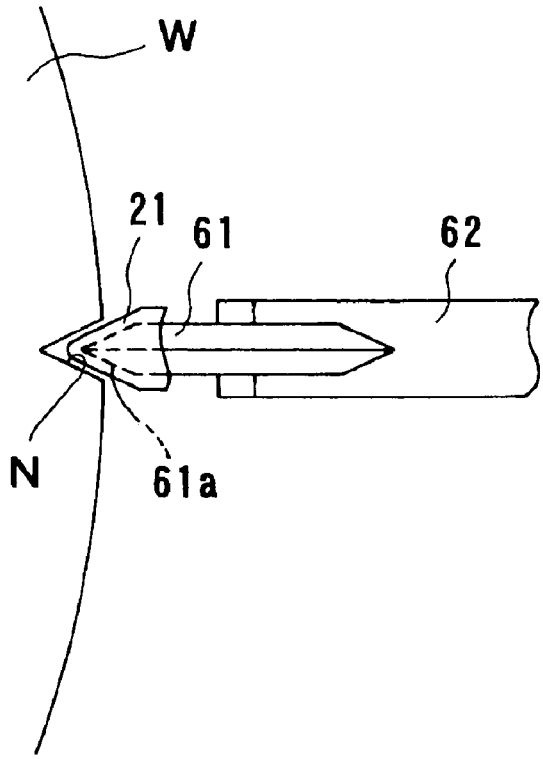
FIG. 12A is a view as viewed in a direction indicated by arrow XII in FIG. 11.
Figure 12B:
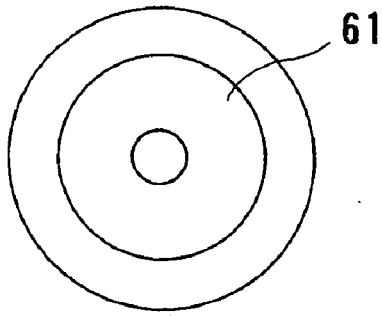
FIG. 12B is a side elevational view of a resilient roller for pressing a polishing tape against a notch in a semiconductor wafer.

Structural details of the notch polisher 60 will be described below with reference to FIGS. 10 through 13A–13C. FIG. 10 shows in side elevation an overall arrangement of the notch polisher 60. FIG. 11 shows in side elevation an actuating mechanism of the notch polisher 60. FIG. 12A is a view as viewed in the direction indicated by arrow XII in FIG. 11, and FIG. 12B is a side elevational view of a resilient roller for pressing a polishing tape against a notch in the semiconductor wafer W. As shown in FIGS. 10 and 11, the notch polisher 60 has a resilient roller 61 for pressing a polishing tape 21 against a notch in the semiconductor wafer W. The resilient roller 61 is rotatably supported on a distal end of a support arm 62, and a gear 63 is fixed to a rear end of the support arm 62. As shown in FIGS. 12A and 12B, the resilient roller 61 is made of silicone rubber or the like and is in the form of a disk having an outer circumferential edge 61*a* which is tapered. This tapered outer circumferential edge 61*a* is complementary in cross-sectional shape to a notch N in the semiconductor wafer W and can be fitted in the notch N.

The gear 63 is held in mesh with a vertical rack 64 fixedly mounted on an L-shaped support member 65 that is coupled to a rod 66*a* of an air cylinder 66. The support arm 62 is rotatably supported on a support frame 68 by a rotational shaft 69 that is coaxially fixed to the gear 63. The air cylinder 66 has an upper end fixed to the support frame 68. An air cylinder 71 is fixedly mounted on a fixed frame 70 that is fixed to a stationary part such as a base or the like of the polishing unit 10. The support frame 68 is fixed to a rod 71*a* of the air cylinder 71.

The polishing tape 21 is housed in a cassette tape cartridge (not shown), and is supplied from a supply reel RB in the cassette tape cartridge and wound under a given tension by a takeup reel RA in the cassette tape cartridge.

As shown in FIG. 10, a tape drive mechanism 72 for moving the polishing tape 21 in a reciprocating manner during a polishing process is disposed between the supply reel RB and the takeup reel RA. The tape drive mechanism 72 comprises a gear 74 which is coupled to a servomotor (not shown) and is rotatable about a shaft 73, a pair of upper and lower gears 75 which are disposed respectively above and below the gear 74 and rotatable in mesh with the gear 74, and a support lever 76 supporting the upper and lower gears 75 thereon. With this arrangement, when the gear 74 is rotated by the servomotor, the upper and lower gears 75 are rotated about their own axes and also roll around the gear 74, thus causing the support lever 76 to turn around the shaft 73. A pair of upper and lower support rollers 77 is mounted on the support lever 76 in a coaxial relationship with the upper and lower gears 75, respectively. The polishing tape 21 is trained around the upper and lower support rollers 77, and also passes between the semiconductor wafer W and the resilient roller 61. In FIG. 10, the upper and lower support rollers 77 are visible, and the upper and lower gears 75 are concealed from view because they are positioned behind the upper and lower support rollers 77 and the support lever 76.

With the above arrangement, when the gear 74 is rotated counterclockwise by the servomotor, the gears 75 are rotated clockwise, and the support lever 76 is turned counterclockwise around the shaft 73. The polishing tape 21 is pulled toward the takeup reel RA. When the gear 74 is rotated clockwise by the servomotor, the gears 75 are rotated counterclockwise, and the support lever 76 is turned clockwise around the shaft 73. The polishing tape 21 is now pulled toward the supply reel RB. At this time, a reciprocating displacement of the polishing tape 21 is absorbed by upper and lower idle rollers 78*a*, 78*b* that are disposed near the supply reel RB and the takeup reel RA, respectively, and are movable in directions indicated by arrows. The upper and lower idle rollers 78*a*, 78*b* are normally biased by respective upper and roller tensioners 79*a*, 79*b* which comprise tension coil springs. While the polishing tape 21 is being moved vertically in a reciprocating manner by the servomotor, the supply reel RB and the takeup reel RA are locked against rotation by a lock mechanism. Since the polishing tape 21 is moved vertically in a reciprocating manner by the servomotor, a relative speed between a surface, being polished, of the semiconductor wafer W and the polishing tape 21 can be adjusted, thus making it possible to adjust a polishing rate easily.

As shown in FIG. 2, a notch sensor 150 is disposed adjacent to the notch polisher 60. The notch sensor 150 comprises a straight-beam retroreflective sensor which comprises a laser sensor having a light-emitting element and a light-detecting element at the same location, and a reflecting element spaced from the light-emitting element. A laser beam emitted from the light-emitting element passes through the notch N in the semiconductor wafer W, reaches the reflecting element, is reflected by the reflecting element, and returns to the light-detecting element. Only when the notch N in the semiconductor wafer W passes through the light-emitting element, the laser beam is reflected by the reflecting element and returns to the light-detecting element, and hence the notch N is detected. When the notch N in the semiconductor wafer W is detected by the notch sensor 150 while the substrate holding table 12 holding the semiconductor wafer W under vacuum is rotating, the substrate holding table 12 is stopped against rotation to align the notch N with the resilient roller 61 of the notch polisher 60.

When the notch N in the semiconductor wafer W is aligned with the resilient roller 61 of the notch polisher 60 by the notch sensor 150, the notch polisher 60 starts to operate. In the notch polisher 60, the air cylinder 66 operates to move the rod 66*a* upwardly, the rack 64 fixed to the support member 65 also moves upwardly, thus rotating the gear 63 counterclockwise. As a result, the support arm 62 is turned downwardly around the rotational shaft 69 to cause the resilient roller 61 to move to a lower position. When the air cylinder 66 operates to move the rod 66*a* downwardly, the rack 64 fixed to the support member 65 also moves downwardly, thus rotating the gear 63 clockwise. As a result, the support arm 62 is turned upwardly around the rotational shaft 69 to cause the resilient roller 61 to move to an upper position. The air cylinder 66 comprises an air cylinder capable of displacing the rod 66*a* selectively to an upper position, a lower position, and an intermediate position. When the air cylinder 71 operates, the support frame 68 moves forward to displace the resilient roller 61 toward the semiconductor wafer W. The polishing tape 21 is now pressed against the notch N in the semiconductor wafer W by the resilient roller 61.

At this time, the semiconductor wafer W is attracted under vacuum to the substrate holding table 12 of the substrate holder 11, and the substrate holding table 12 is stopped against rotation or held at rest. The servomotor is energized to swing the support lever 76 of the tape drive mechanism 72 for moving the polishing tape 21 vertically in a reciprocating manner. The polishing tape 21 and the notch N in the semiconductor wafer W now move in sliding contact with each other, and hence the notch N in the semiconductor wafer W is polished. A pressure for pressing the polishing tape 21 against the notch N can be adjusted by regulating pressure of compressed air that is supplied to the air cylinder 71. For example, the polishing tape 21 is pressed against the notch N under a pressure of about 98 kPa. At this time, a chemical liquid or pure water is supplied from a chemical liquid supply nozzle 67 to an area where the notch N in the semiconductor wafer W and the polishing tape 21 contact each other, thereby polishing the notch N in the semiconductor wafer W in a wet environment. A portion of the polishing tape 21 which has been worn by polishing the notch N in the semiconductor wafer W is displaced toward the takeup reel RA before a polishing rate is significantly lowered, thereby bringing a fresh portion of the polishing tape 21 into contact with the semiconductor wafer W.

Figure 13A:
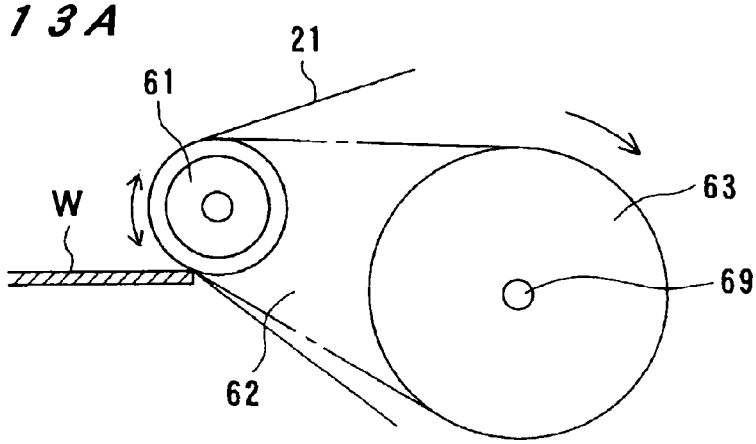
FIGS. 13A through 13C are views showing a relationship between the notch polisher and the semiconductor wafer at a time the notch in the semiconductor wafer is polished by the notch polisher, with FIG. 13A being a view illustrative of a manner in which an upper edge of the notch is polished, FIG. 13B being a view illustrative of a manner in which a radially outward edge of the notch is polished, and FIG. 13C being a view illustrative of a manner in which a lower edge of the notch is polished.
Figure 13B:
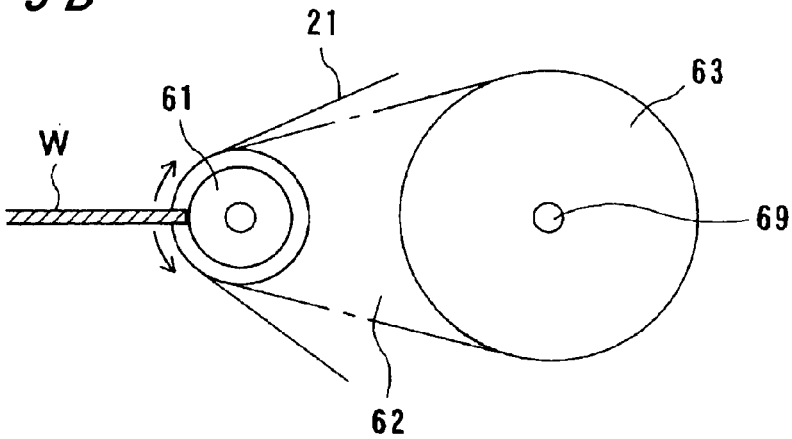
Figure 13C:
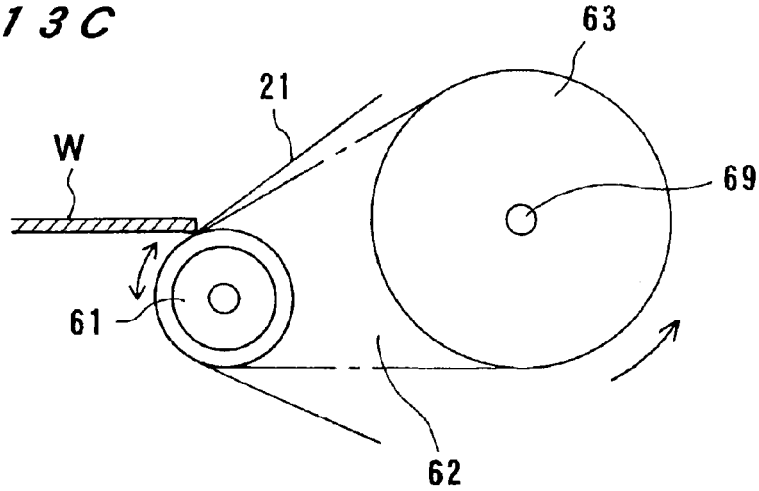

FIGS. 13A through 13C show a relationship between the notch polisher 60 and the semiconductor wafer W at a time the notch N in the semiconductor wafer W is polished by the notch polisher 60. FIG. 13A is a view illustrative of a manner in which an upper edge of the notch N in the semiconductor wafer W is polished, FIG. 13B is a view illustrative of a manner in which a radially outward edge of the notch N in the semiconductor wafer W is polished, and FIG. 13C is a view illustrative of a manner in which a lower edge of the notch N in the semiconductor wafer W is polished.

As shown in FIG. 13A, when an upper edge of the notch N in the semiconductor wafer W is to be polished, the rod 66*a* of the air cylinder 66 of the notch polisher 60 is displaced to a lower position to rotate the gear 63 clockwise for thereby turning the support arm 62 upwardly around the rotational shaft 69. Thus, the resilient roller 61 is displaced to an upper position. The air cylinder 71 is actuated to move the support frame 68 forward (see FIG. 11), thereby displacing the resilient roller 61 toward the semiconductor wafer W. The polishing tape 21 is now pressed against the upper edge of the notch N in the semiconductor wafer W by the resilient roller 61. The polishing tape 21 is vertically moved in a reciprocating manner to polish the upper edge of the notch N.

As shown in FIG. 13B, when a radially outward edge of the notch N in the semiconductor wafer W is to be polished, the rod 66*a* of the air cylinder 66 of the notch polisher 60 is displaced to an intermediate position to bring the support arm 62 into a substantially horizontal position. The air cylinder 71 is actuated to move the support frame 68 forward (see FIG. 11), thereby displacing the resilient roller 61 toward the semiconductor wafer W. The polishing tape 21 is now pressed against the radially outward edge of the notch N in the semiconductor wafer W by the resilient roller 61. The polishing tape 21 is vertically moved in a reciprocating manner to polish the radially outward edge of the notch N.

As shown in FIG. 13C, when a lower edge of the notch N in the semiconductor wafer W is to be polished, the rod 66*a* of the air cylinder 66 of the notch polisher 60 is displaced to an upper position to rotate the gear 63 counterclockwise for thereby turning the support arm 62 downwardly around the rotational shaft 69, and hence the resilient roller 61 is displaced to a lower position. The air cylinder 71 is actuated to move the support frame 68 forward (see FIG. 11), thereby displacing the resilient roller 61 toward the semiconductor wafer W. The polishing tape 21 is now pressed against the lower edge of the notch N in the semiconductor wafer W by the resilient roller 61. The polishing tape 21 is vertically moved in a reciprocating manner to polish the lower edge of the notch N.

In this manner, the notch polisher 60 is capable of polishing each of the upper edge, the radially outward edge, and the lower edge of the notch N in the semiconductor wafer W. Therefore, the notch N can be polished ideally to match a configuration of the bevel portion of the semiconductor wafer W.

Figure 14A:
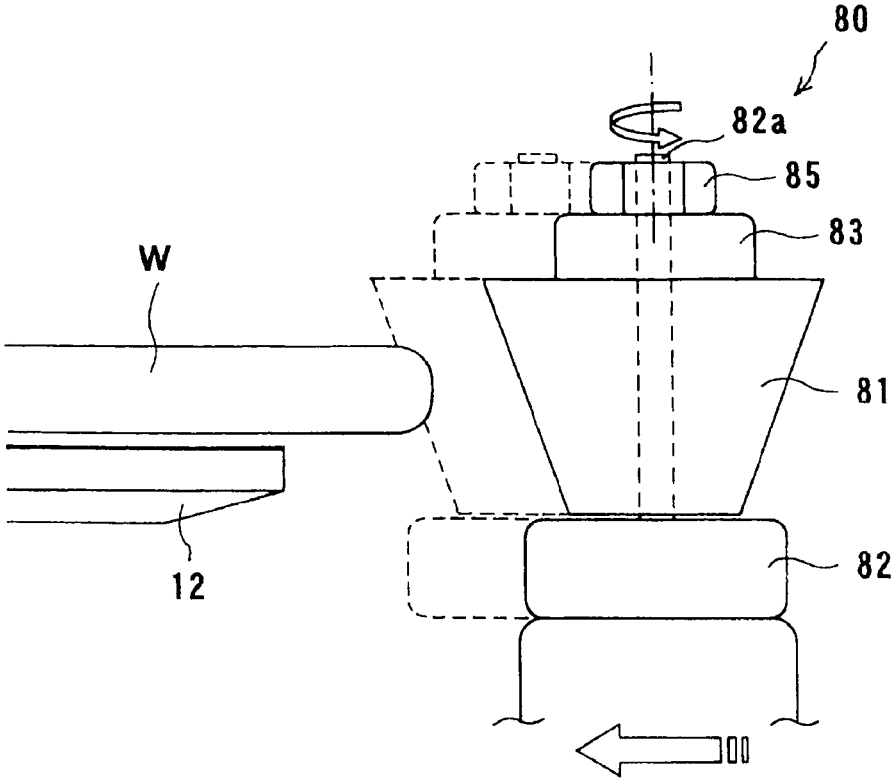
FIGS. 14A and 14B are views showing cleaning units for conducting a primary cleaning of a polished semiconductor wafer.
Figure 14B:
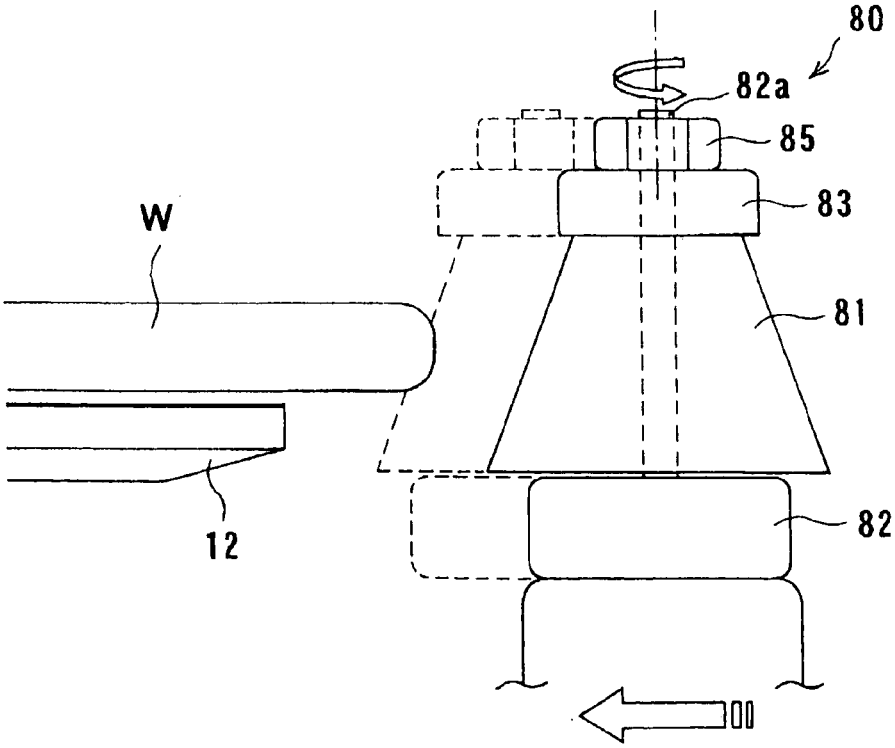
Figure 15:
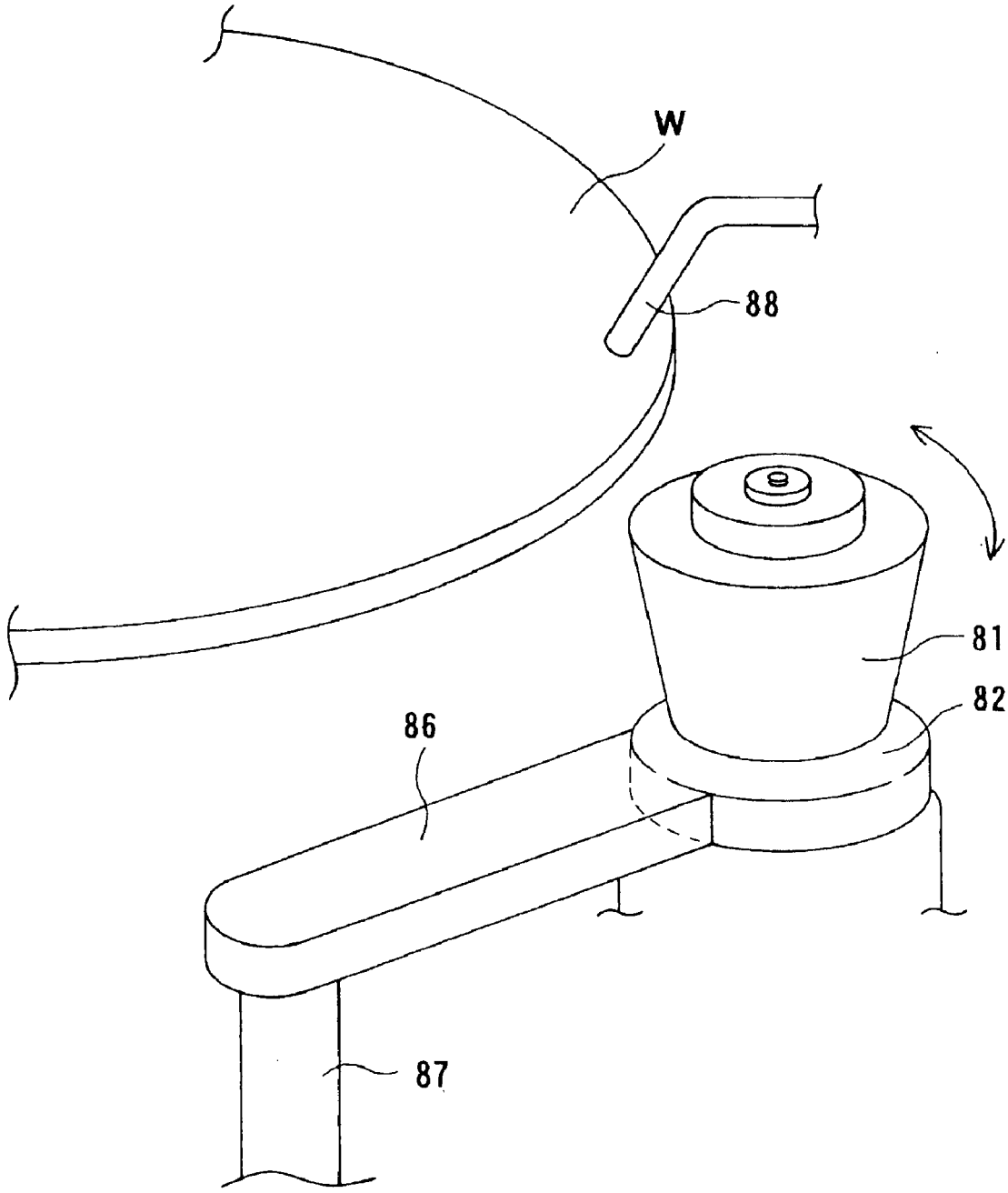
FIG. 15 is a perspective view of one of the cleaning units.

The cleaning devices 80 for conducting a primary cleaning of a polished semiconductor wafer W will be described below with reference to FIGS. 14A, 14B and 15. FIGS. 14A and 14B are views showing cleaning devices 80, and FIG. 15 is a perspective view of one of the cleaning devices 80. The polishing unit 10 has three cleaning devices 80 angularly spaced around the semiconductor wafer W. The cleaning devices 80 are available in two types, one shown in FIG. 14A and the other shown in FIG. 14B. The polishing unit 10 has two cleaning devices 80 shown in FIG. 14A and one cleaning device 80 shown in FIG. 14B. The cleaning devices 80 shown in FIG. 14A and the cleaning device 80 shown in FIG. 14B differ from each other in that they use frustoconical sponge rollers 81 inverted upside down relative to one another.

As shown in FIGS. 14A and 14B, the sponge roller 81 is supported on a rotational shaft 82*a* of a rotary base 82 coupled to a motor (not shown). The sponge roller 81 is made of sponge of PVA (polyvinyl alcohol), and is fixed to the rotational shaft 82*a* by a disk-shaped fixing plate 83 and a nut 85 held against the fixing plate 83 and screwed over the rotational shaft 82*a*. When the rotary base 82 is rotated by the motor, the sponge roller 81 is rotated at a rotational speed of 0 to 110 rpm ($min^{-1}$).

As shown in FIG. 15, the sponge roller 81 and the rotary base 82 are supported on a swing arm 86 that is fixed to an upper end of a support shaft 87 coupled to a motor (not shown). When the motor is rotated in one direction or the other, the support shaft 87 is rotated clockwise or counterclockwise about its own axis, thereby turning the swing arm 86. As a result, the sponge roller 81 is displaced into a cleaning position in which the sponge roller 81 is pressed against the bevel and edge portions of the semiconductor wafer W over a predetermined pressed area or under a predetermined pressure to clean the bevel and edge portions, or a retracted position in which the sponge roller 81 is spaced from the semiconductor wafer W.

With the above arrangement, the edge portion, the bevel portion, and the notch of the semiconductor wafer W are polished respectively by the clamping polisher 20, the pushing polisher 40, and the notch polisher 60, and then the swing arm 86 is turned to move the sponge roller 81 from the retracted position to the cleaning position. In the cleaning position, the sponge roller 81 contacts the bevel and edge portions of the semiconductor wafer W to clean the bevel and edge portions. At this time, a cleaning liquid such as pure water or a chemical liquid is supplied from a cleaning liquid supply nozzle 88 to the semiconductor wafer W. Then, light etching may be performed on the semiconductor wafer W with an acid-base chemical liquid such as hydrofluoric acid to eliminate processing damage. While the semiconductor wafer W is being cleaned, the rotational speed of the sponge roller 81 is adjusted in the range of 0 to 110 rpm ($min^{-1}$). Then, since the semiconductor wafer W is attracted under vacuum to the substrate holding table 12 of the substrate holder 11 and the substrate holding table 12 is rotated at a predetermined speed of 0 to 1500 rpm ($min^{-1}$) by the motor 14, the sponge roller 81 and the bevel and edge portions of the semiconductor wafer W are held in sliding contact with each other, thus cleaning the bevel and edge portions of the semiconductor wafer W. In the cleaning process, the inverted frustoconical sponge roller 81 shown in FIG. 14A is held in sliding contact with the bevel portion and the upper surface of the edge portion of the semiconductor wafer W, and the frustoconical sponge roller 81 shown in FIG. 14B is held in sliding contact with the bevel portion and the lower surface of the edge portion of the semiconductor wafer W. In this manner, the inverted frustoconical sponge roller 81 and the frustoconical sponge roller 81 are combined with each other to simultaneously clean the bevel portion and the upper and lower surfaces of the edge portion of the semiconductor wafer W. The sponge roller 81 may have vertical grooves defined in its cleaning surface, i.e., a frustoconical outer circumferential surface. When the cleaning surface of the sponge roller 81 is worn, a height of the substrate holding table 12 or a height of the sponge roller 81 may be adjusted to bring an unworn cleaning surface of the sponge roller 81 into contact with a circumferential portion of the semiconductor wafer W.

Next, polishing end point detecting apparatuses for detecting a polishing end point in the polishing unit 10 will be described with reference to FIGS. 16 through 18A and 18B.

Figure 16:
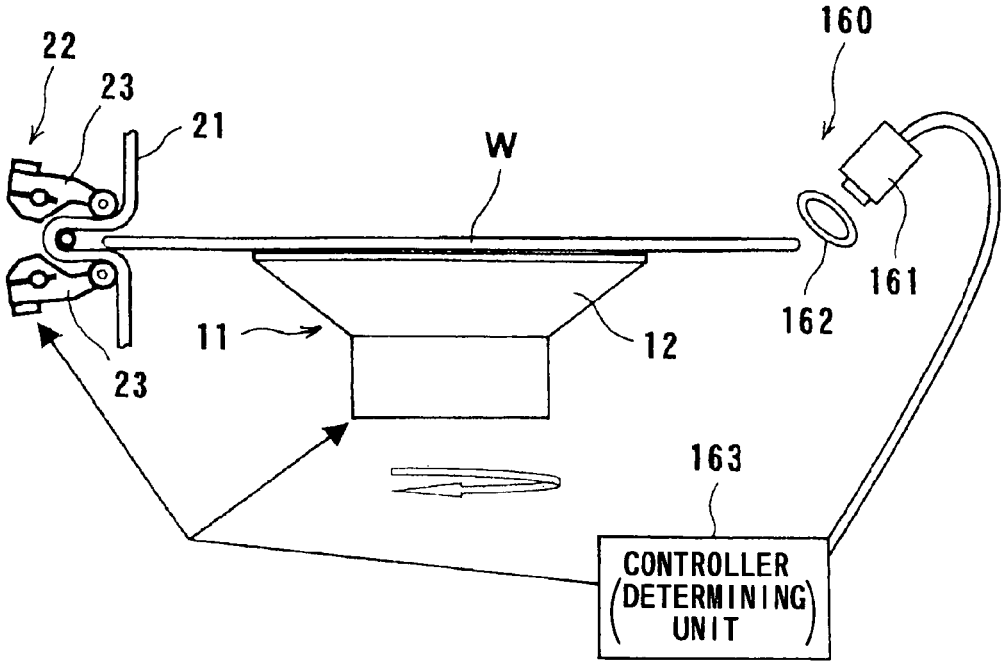
FIG. 16 is a side elevational view of a polishing end point detecting apparatus for detecting a polishing end point when an edge portion of a semiconductor wafer is polished by the clamping polisher.

FIG. 16 shows in side elevation a polishing end point detecting apparatus for detecting a polishing end point when the edge portion of the semiconductor wafer W is polished by the clamping polisher 20. As shown in FIG. 16, a polishing end point detecting apparatus 160 comprises an image sensor 161 comprising a CCD camera, a ring-shaped illuminating unit 162 disposed between the image sensor 161 and the semiconductor wafer W, which is an object to be inspected, and a controller 163 connected to the image sensor 161 for determining whether or not a polishing end point has been reached on the basis of an image acquired by the image sensor 161.

The polishing end point detecting apparatus 160 operates as follows: While the edge portion of the semiconductor wafer W is being polished by the clamping polisher 20, the edge portion of the semiconductor wafer W is illuminated by the ring-shaped illuminating unit 162, and is imaged by the image sensor 161. The image acquired by the image sensor 161 is inputted to the controller 163, and the controller 163 observes a film color change on the edge portion of the semiconductor wafer W and detects a polishing end point on the basis of this observed film color change. When the controller 163 detects a polishing end point, the controller 163 sends an end point detection signal to the clamping polisher 20 and the substrate holder 11 to open the clamp arms 23 of the polishing head 22 of the clamping polisher 20, thereby terminating a polishing process and also stopping rotation of the substrate holding table 12 of the substrate holder 11. In the embodiment shown in FIG. 16, the clamping polisher 20 polishes the edge portion of the semiconductor wafer W and the polishing end point detecting apparatus 160 detects a polishing end point of the edge portion. However, the pushing polisher 40 may polish the bevel portion of the semiconductor wafer W and the polishing end point detecting apparatus 160 may detect a polishing end point of the bevel portion.

Figure 17:
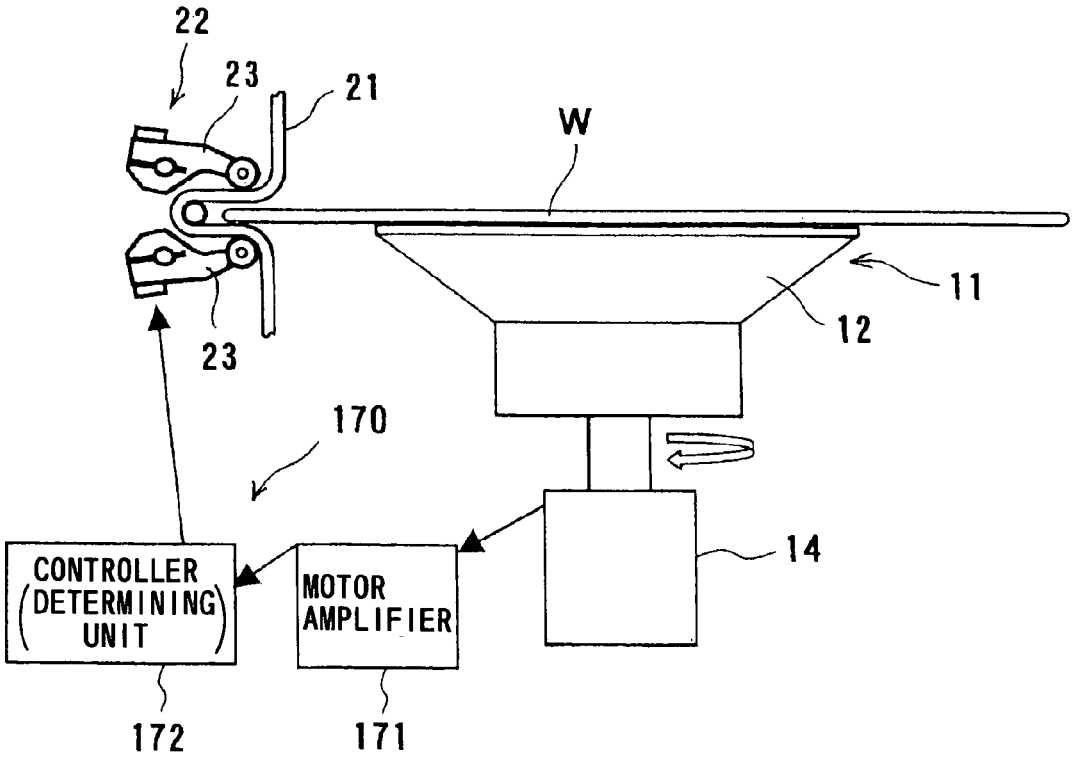
FIG. 17 is a side elevational view of another polishing end point detecting apparatus for detecting a polishing end point when an edge portion of a semiconductor wafer is polished by the clamping polisher.

FIG. 17 shows in side elevation another polishing end point detecting apparatus for detecting a polishing end point when the edge portion of the semiconductor wafer W is polished by the clamping polisher 20. As shown in FIG. 17, a polishing end point detecting apparatus 170 comprises a motor amplifier 171 connected to the motor 14 comprising a servomotor for rotating the substrate holding table 12 of the substrate holder 11, and a controller 172 for reading a signal amplified by the motor amplifier 171 to determine whether or not a polishing end point has been reached.

The polishing end point detecting apparatus 170 operates as follows: While the edge portion of the semiconductor wafer W is being polished by the clamping polisher 20, a signal (e.g., a motor current value) from the motor 14, which is rotating the substrate holding table 12 holding the semiconductor wafer W under vacuum, is amplified by the motor amplifier 171, and this amplified signal is sent to the controller 172. The controller 172 detects a torque value required to rotate the motor 14 based on the signal from the motor amplifier 171, and analyzes a change in the torque value to detect a polishing end point. When the controller 172 detects a polishing end point, the controller 172 sends an end point detection signal to the clamping polisher 20 to open the clamp arms 23 of the polishing head 22 of the clamping polisher 20, thereby terminating a polishing process and also de-energizing the motor 14 to stop rotation of the substrate holding table 12. In the embodiment shown in FIG. 17, the clamping polisher 20 polishes the edge portion of the semiconductor wafer W and the polishing end point detecting apparatus 170 detects a polishing end point of the edge portion. However, the pushing polisher 40 may polish the bevel portion of the semiconductor wafer W and the polishing end point detecting apparatus 170 may detect a polishing end point of the bevel portion. Alternatively, a torque gage may be installed on the rotational shaft of the substrate holding table 12 to directly detect a torque value of the substrate holding table 12, and a change in the torque value may be analyzed to detect a polishing end point.

Figure 18A:
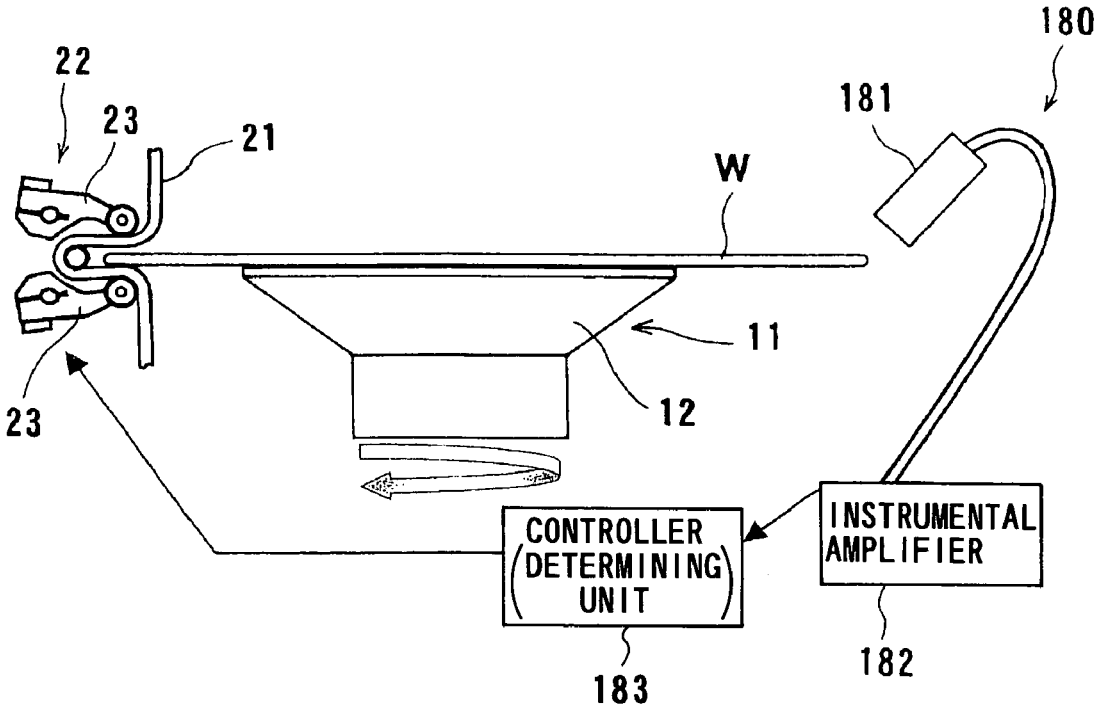
FIGS. 18A and 18B are views of still another polishing end point detecting apparatus for detecting a polishing end point when an edge portion of a semiconductor wafer is polished by the clamping polisher, with FIG. 18A being a side elevational view showing an overall arrangement of the polishing end point detecting apparatus, and FIG. 18B being a view of a photosensor comprising a light-emitting element and a light-detecting element.
Figure 18B:
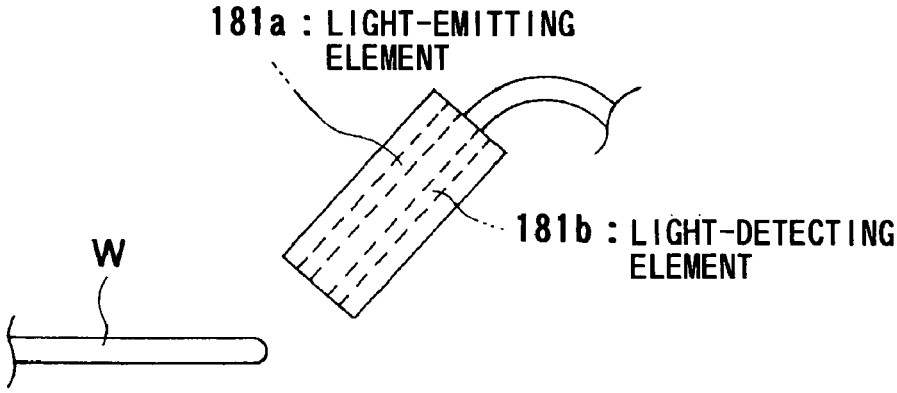

FIGS. 18A and 18B show still another polishing end point detecting apparatus for detecting a polishing end point when the edge portion of the semiconductor wafer W is polished by the clamping polisher 20. FIG. 18A is a side elevational view showing an overall arrangement of the polishing end point detecting apparatus, and FIG. 18B is a view of a photosensor comprising a light-emitting element and a light-detecting element. As shown in FIGS. 18A and 18B, a polishing end point detecting apparatus 180 comprises a photosensor 181 having a light-emitting element 181*a* and a light-detecting element 181*b*, an instrumental amplifier 182 connected to the photosensor 181 for measuring and amplifying a light signal detected by the light-detecting element 181*b*, and a controller 183 connected to the instrumental amplifier 182 for reading a signal amplified by the instrumental amplifier 182 to determine whether or not a polishing end point has been reached.

The polishing end point detecting apparatus 180 operates as follows: While the edge portion of the semiconductor wafer W is being polished by the clamping polisher 20, the light-emitting element 181*a* of the photosensor 181 applies a light beam to the edge portion of the semiconductor wafer W, and the light-detecting element 181*b* detects scattered light reflected by the edge portion. The scattered light detected by the light-detecting element 181*b* is amplified by the instrumental amplifier 182, and the instrumental amplifier 182 sends an amplified signal to the controller 183. The controller 183 analyzes the scattered light based on the amplified signal from the instrumental amplifier 182, and evaluates a roughness of a polished state of the edge portion to detect a polishing end point.

Figure 19A:
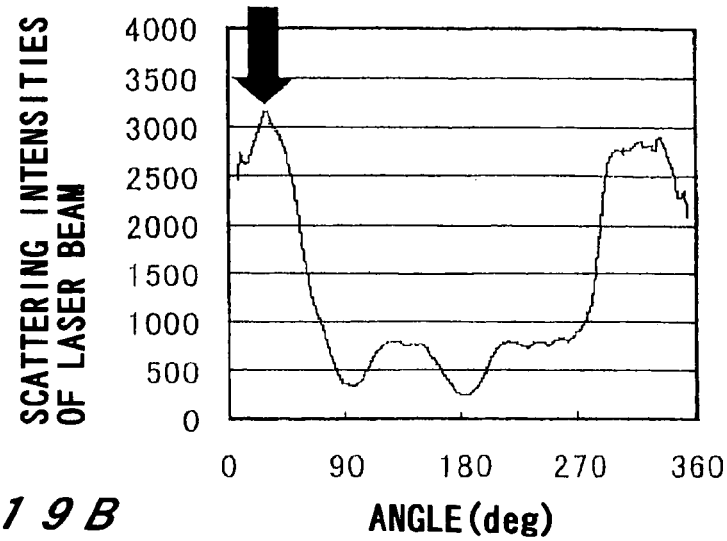
FIGS. 19A through 19C are graphs showing examples in which an end point is detected based on scattered light, with FIG. 19A showing data before an edge portion is polished, FIG. 19B showing data when the edge portion is not sufficiently polished, and FIG. 19C showing data when polishing of the edge portion is completed.
Figure 19B:
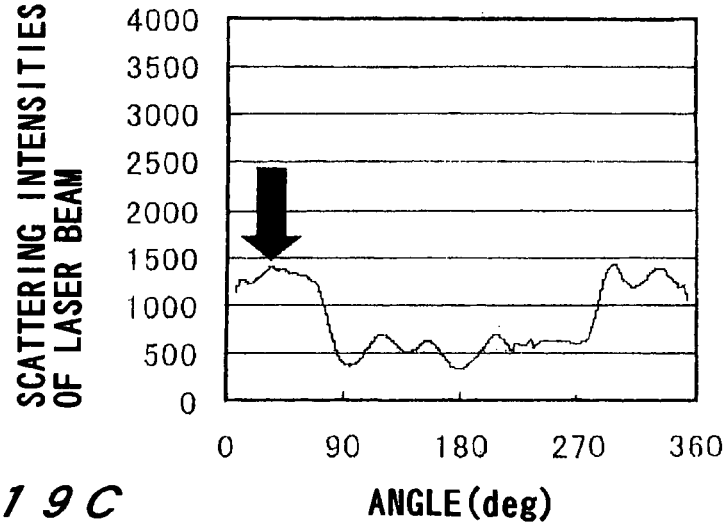
Figure 19C:
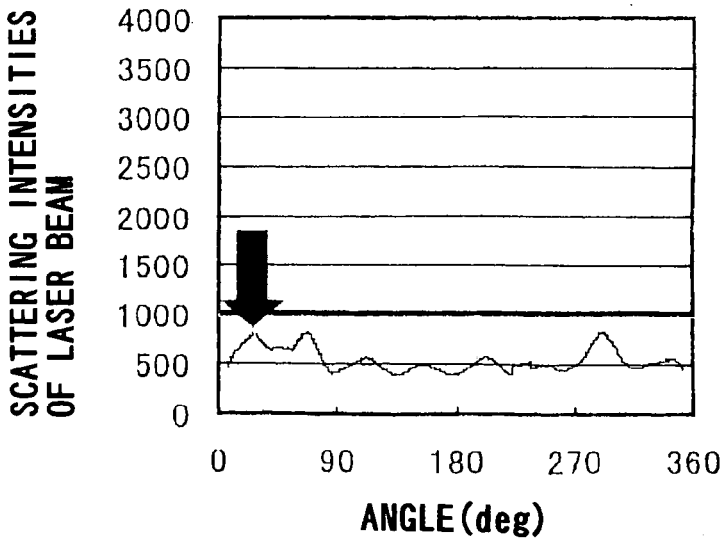

FIGS. 19A through 19C are graphs showing examples in which an end point is detected based on scattered light. FIG. 19A shows data before the edge portion is polished, FIG. 19B shows data when the edge portion is not sufficiently polished, and FIG. 19C shows data when polishing of the edge portion is completed. In FIGS. 19A through 19C, the horizontal axis represents angles in a circumferential direction of the semiconductor wafer W, and the vertical axis represents scattering intensities of a laser beam. As shown in FIGS. 19A through 19C, a polishing end point may be judged when the scattering intensity of the laser beam over an entire circumference of the semiconductor wafer W has dropped to a certain value, for example, 1000 or lower.

When the controller 183 detects a polishing end point based on the scattering intensities of the laser beam shown in FIGS. 19A through 19C, the controller 183 sends an end point detection signal to the clamping polisher 20 and the substrate holder 11 to open the clamp arms 23 of the polishing head 22 of the clamping polisher 20, thereby terminating a polishing process and also stopping rotation of the substrate holding table 12 of the substrate holder 11. In the embodiment shown in FIGS. 18A and 18B, the clamping polisher 20 polishes the edge portion of the semiconductor wafer W and the polishing end point detecting apparatus 180 detects a polishing end point of the edge portion. However, the pushing polisher 40 may polish the bevel portion of the semiconductor wafer W and the polishing end point detecting apparatus 180 may detect a polishing end point of the bevel portion.

The polishing end point detecting apparatus which optically detects a polishing end point as shown in FIGS. 16 and 18 may be combined with the notch polisher 60 to detect a polishing end point of the notch N in the semiconductor wafer W.

In each of the clamping polisher 20, the pushing polisher 40, and the notch polisher 60, because the polishing tape 21 is held in sliding contact with a region, being polished, of the semiconductor wafer W, a tension (tensile stress) applied to the polishing tape 21 may be detected by a strain gage or the like, and a change in the tension during a polishing process may be analyzed to detect a polishing end point. According to this modification, because the polishing tape 21 is pulled in a direction in which the semiconductor wafer W held under vacuum by the substrate holding table 12 rotates in each of the clamping polisher 20 and the pushing polisher 40, the polishing tape 21 undergoes a tension (tensile stress) in a direction in which the semiconductor wafer W rotates. The tension is detected by a strain gage or the like, and a change in the tension is analyzed by the controller to detect a polishing end point. In the notch polisher 60, the polishing tape 21 undergoes a tension (tensile stress) in a direction in which the polishing tape 21 moves in a reciprocating manner, and the tension is detected by a strain gage or the like, and a change in the tension is analyzed by the controller to detect a polishing end point.

Alternatively, in each of the clamping polisher 20, the pushing polisher 40, and the notch polisher 60, a tension (tensile stress) applied to a mechanism (the clamp arms 23 of the polishing head 22 of the clamping polisher 20, the resilient member 43 of the polishing head 41 of the pushing polisher 40, and the resilient roller of the notch polisher 60) for applying a polishing pressure to a region, being polished, of the semiconductor wafer W from a reverse surface of the polishing tape 21 may be detected by a strain gage or the like, and a change in the tension during a polishing process may be analyzed to detect a polishing end point. According to this modification, because the polishing tape 21 is pulled in a direction in which the semiconductor wafer W held under vacuum by the substrate holding table 12 rotates in each of the clamping polisher 20 and the pushing polisher 40, the polishing tape 21 undergoes a tension (tensile stress)

in a direction in which the semiconductor wafer W rotates. The tension is detected by a strain gage or the like, and a change in the tension is analyzed by the controller to detect a polishing end point. In the notch polisher 60, the polishing tape 21 undergoes a tension (tensile stress) in a direction in which the polishing tape 21 moves in a reciprocating manner, and the tension is detected by a strain gage or the like, and a change in the tension is analyzed by the controller to detect a polishing end point.

The polishing end point may be detected or progress (change) of a polishing process may be monitored simultaneously with or separately from the polishing process for polishing the edge portion and the polishing process for polishing the bevel portion. If the polishing process for polishing the edge portion and the polishing process for polishing the bevel portion are performed simultaneously, then when a polishing end point is detected in either one of these polishing processes, a polishing action in the polishing process whose polishing end point is detected is finished without stopping rotation of the substrate holding table 12, and a polishing action in the other polishing process is continued until its polishing end point is detected.

The polishing process for polishing the notch in the semiconductor wafer W may be performed before or after or between the polishing process of the edge portion and the polishing process of the bevel portion, and the polishing end point may be detected or progress (change) of the polishing process may be monitored without using rotation (torque) of the substrate holding table 12 in the polishing process of the notch in the semiconductor wafer W.

Next, structural details of the cleaning unit 5 for performing a secondary cleaning of the semiconductor wafer W which has been subjected to a primary cleaning after polishing in the polishing unit 10 will be described with reference to FIGS. 20A and 20B.

Figure 20A:
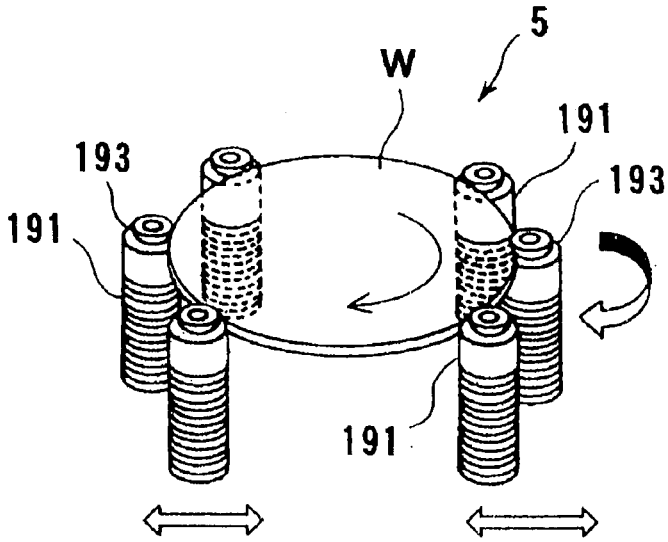
FIGS. 20A and 20B are views showing a cleaning unit, with FIG. 20A being a perspective view of a rotating mechanism for rotating a semiconductor wafer in the cleaning unit, and FIG. 20B being a perspective view of a cleaning mechanism for cleaning a semiconductor wafer in the cleaning unit.
Figure 20B:
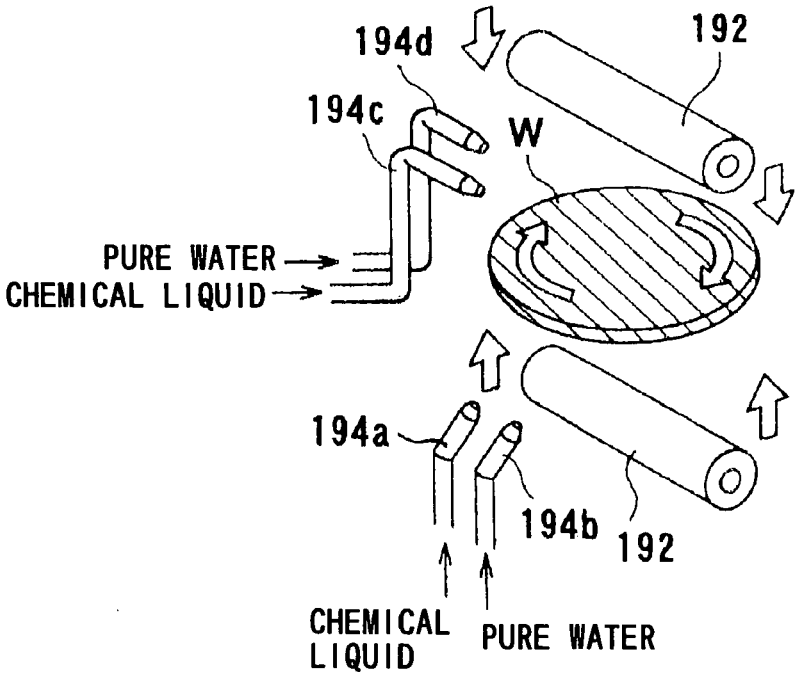

FIGS. 20A and 20B are schematic views showing the cleaning unit 5, with FIG. 20A being a schematic view showing a rotating mechanism of the semiconductor wafer W in the cleaning unit, and FIG. 20B being a schematic view showing a cleaning mechanism of the semiconductor wafer W in the cleaning unit. As shown in FIGS. 20A and 20B, the cleaning unit 5 comprises a dual-roller low-speed-rotation cleaning unit, which has a plurality of vertical rollers 191 for holding the semiconductor wafer W, and roller-type cleaning elements 192 made of sponge or the like for scrubbing surfaces of the semiconductor wafer W.

As shown in FIG. 20A, the rollers 191 of the cleaning unit 5 are radially movable and rotatable about their own axes. These rollers 191 are disposed around the semiconductor wafer W so as to surround the semiconductor wafer W. Each of the rollers 191 has a gripping groove 193 formed in an upper portion thereof for receiving a peripheral portion of the semiconductor wafer W therein to hold the semiconductor wafer W on the rollers 191. When the rollers 191 are rotated about their own axes, the semiconductor wafer W held by the rollers 191 is rotated about its center.

The cleaning elements 192 of the cleaning unit 5 are rotatable about their own axes. As shown in FIG. 20B, the cleaning elements 192 of the cleaning unit 5 are vertically movable and are disposed respectively above and below the semiconductor wafer W. The cleaning elements 192 can be brought into contact with the surfaces of the semiconductor wafer W by their vertical movement. In the cleaning unit 5, there are provided a chemical liquid supply nozzle 194*a* for supplying an etching liquid to a reverse side of the semiconductor wafer W, a pure water supply nozzle 194*b* for supplying pure water to the reverse side of the semiconductor wafer W, a chemical liquid supply nozzle 194*c* for supplying an etching liquid to a face side of the semiconductor wafer W, and a pure water supply nozzle 194*d* for supplying pure water to the face side of the semiconductor wafer W.

Next, structural details of the cleaning unit 6 will be described with reference to FIGS. 21A and 21B.

Figure 21A:
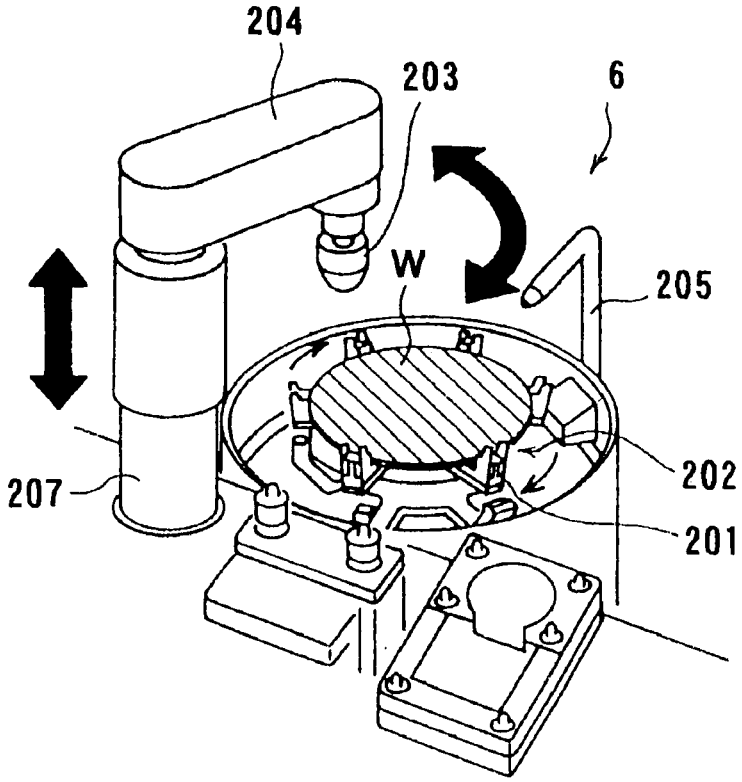
FIGS. 21A and 21B are views showing a cleaning unit, with FIG. 21A being a perspective view of an overall arrangement of the cleaning unit, and FIG. 21B being a perspective view of an essential part of the cleaning unit.
Figure 21B:
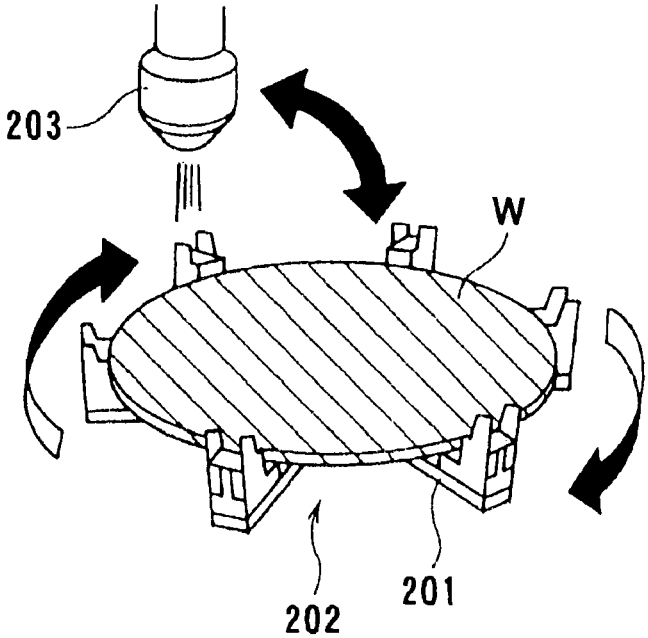
Figure 22:
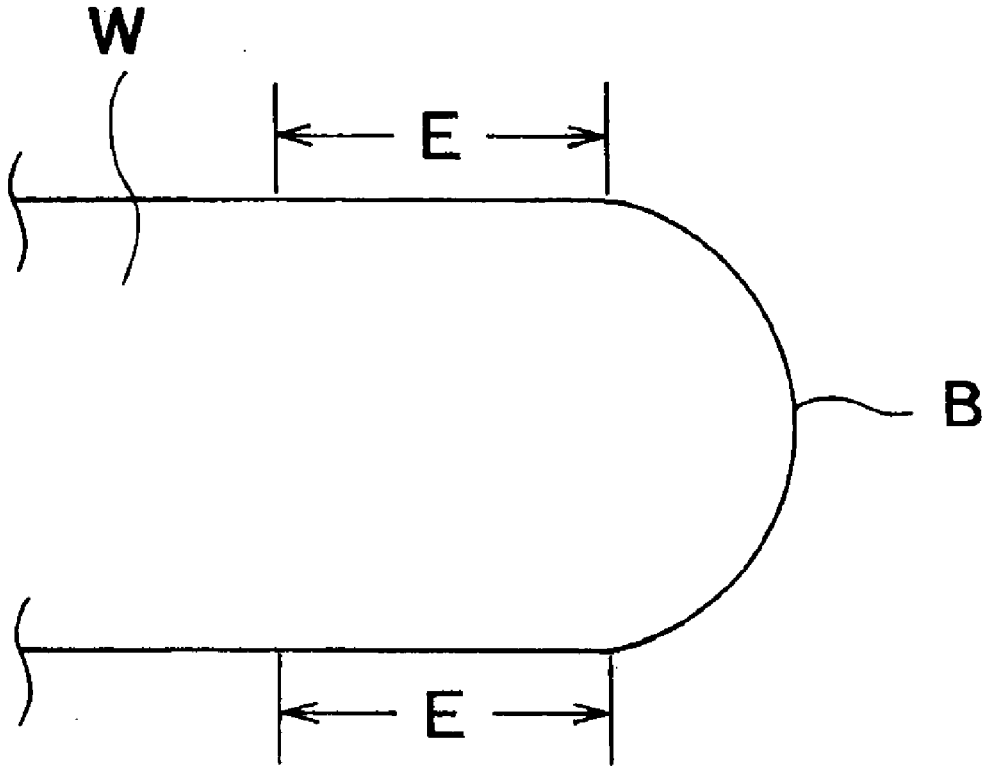
FIG. 22 is a view showing a bevel portion and an edge portion of a semiconductor wafer.
Figure 23A:
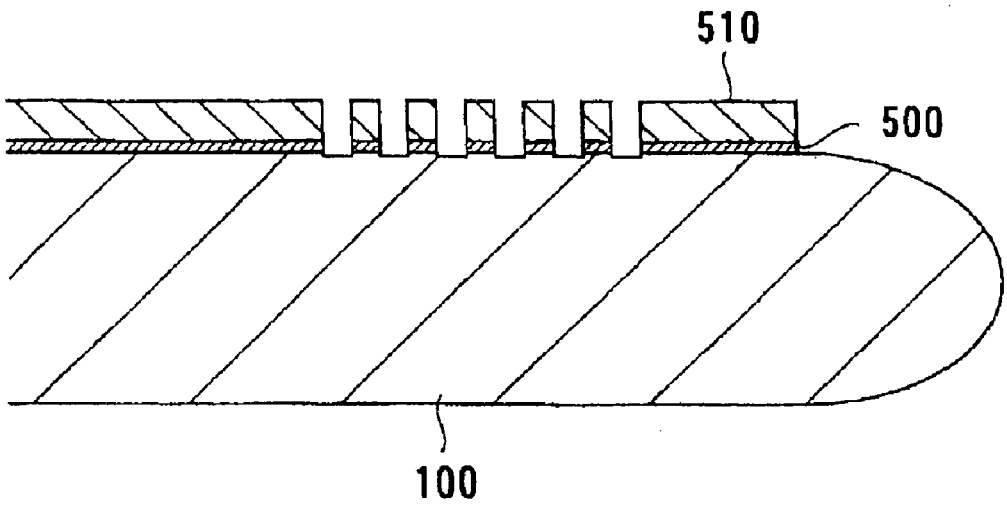
FIGS. 23A and 23B are cross-sectional views illustrative of a process for forming deep trenches of a trench capacitor.
Figure 23B:
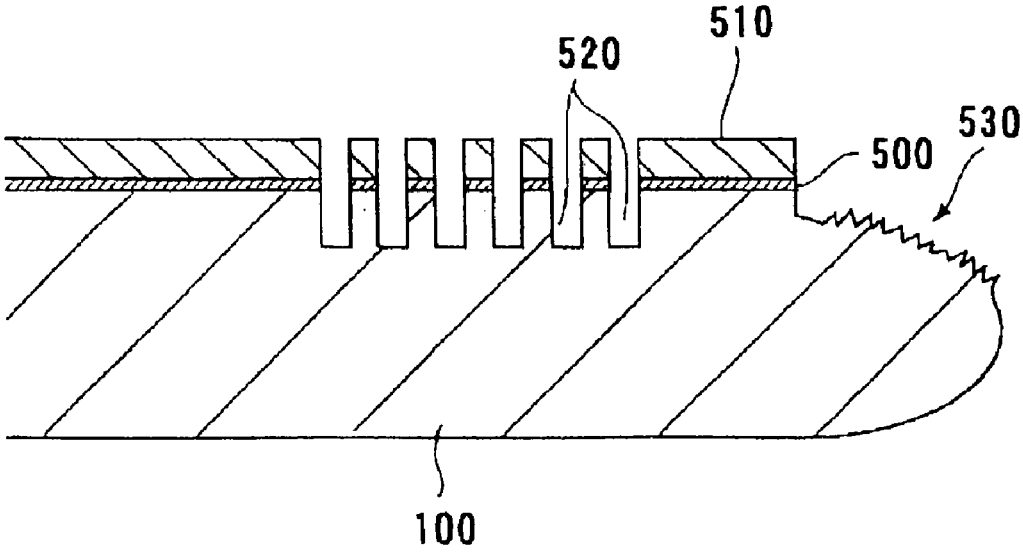
Figure 24A:
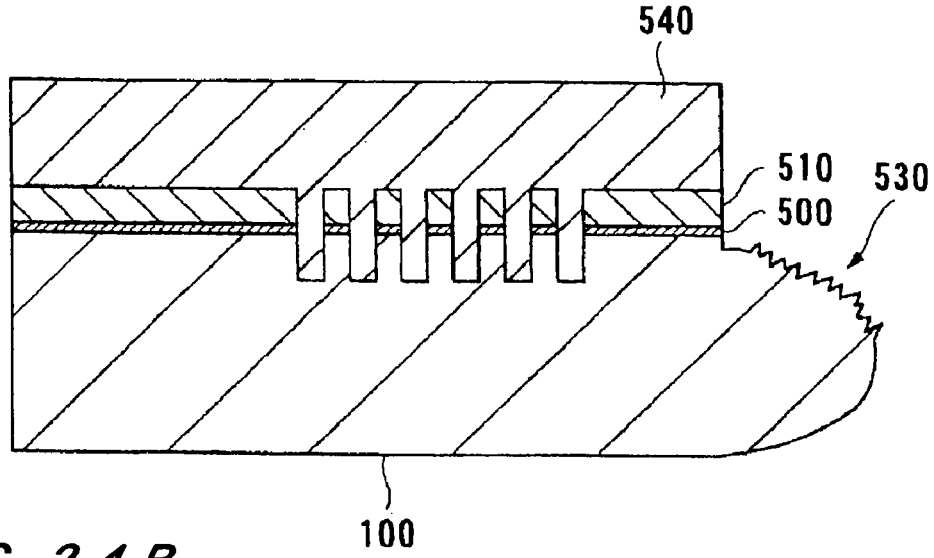
FIGS. 24A through 24C are cross-sectional views illustrative of a process of removing needle-like projections that are produced when deep trenches are formed.
Figure 24B:
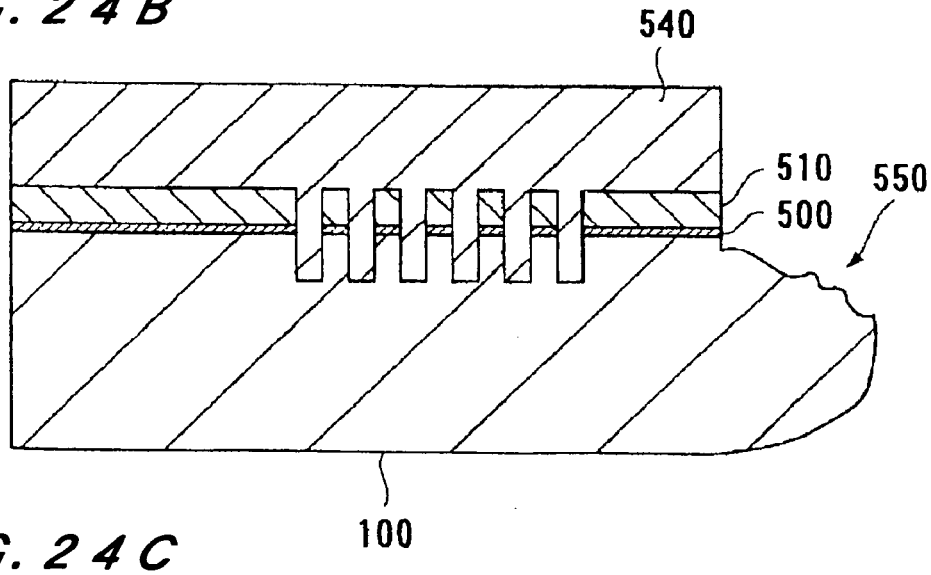
Figure 24C:
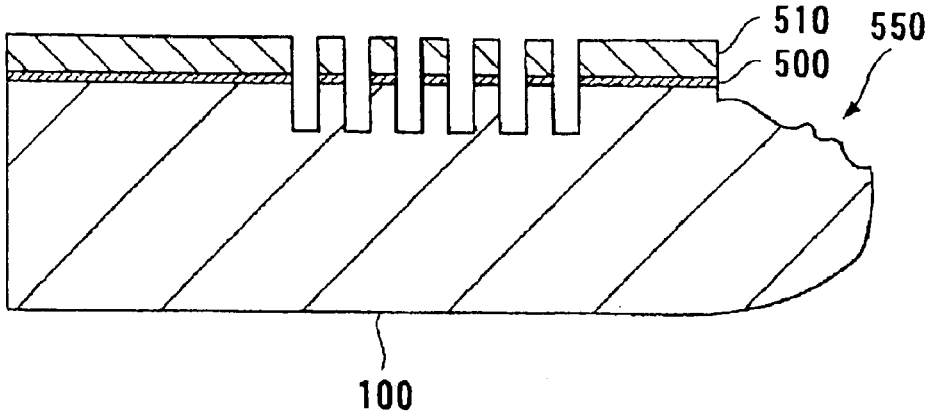

FIGS. 21A and 21B are schematic views showing the cleaning unit 6, with FIG. 21A being a schematic view showing an overall arrangement of the cleaning unit, and FIG. 21B being a schematic view showing an essential part of the cleaning unit. As shown in FIGS. 21A and 21B, the cleaning unit 6 comprises a rotating table 202 having a plurality of arms 201 for holding the semiconductor wafer W. The arms 201 are mounted on and extended radially outwardly from an upper end of a rotatable shaft (not shown). The rotating table 202 can rotate the semiconductor wafer W at high speeds ranging from 1500 to 5000 rpm ($min^{-1}$).

As shown in FIG. 21A, a swing arm 204 having a nozzle 203 is provided in the cleaning unit 6. The swing arm 204 is fixed to a support shaft 207. The support shaft 207 is rotatable and vertically movable. By rotation of the support shaft 207, the swing arm 204 is swung to displace the nozzle 203 into a cleaning position in which the semiconductor wafer W is cleaned, or a retracted position in which the nozzle 203 is spaced from the cleaning position. When the nozzle 203 is in the cleaning position, an ultrasonically vibrated cleaning liquid is supplied from the nozzle 203 onto the upper surface of the semiconductor wafer W. Thus, the cleaning unit 6 comprises a megasonic high-speed-rotation cleaning unit.

The cleaning unit 6 also has a gas nozzle 205 for supplying an inert gas, and a heating device (not shown) for heating the semiconductor wafer W to dry the semiconductor wafer W for a purpose of improving a process performance and shortening tact time.

Next, a cleaning process performed by the cleaning unit 5 and the cleaning unit 6 shown in FIGS. 20A and 20B, and 21A and 21B will be described.

First, as described above, the bevel portion, the edge portion, and the notch of the semiconductor wafer W are polished in respective polishing processes in the polishing unit 10. When a polishing end point is detected in each of the polishing processes, all polishing processes stop. Then, a primary cleaning of the semiconductor wafer W which has been polished is conducted by the cleaning devices 80 provided in the polishing unit 10. After completing the primary cleaning of the semiconductor wafer W, the semiconductor wafer W is transferred to the cleaning unit 5 by the second transfer robot 3. Thereafter, a secondary cleaning of the semiconductor wafer W is conducted in the cleaning unit 5. In the cleaning unit 5, the rollers 191 hold the semiconductor wafer W, and the upper and lower roller sponges (cleaning elements) 192 are moved downwardly and upwardly, respectively, into contact with the upper and lower surfaces, respectively, of the semiconductor wafer W. In this state, pure water is supplied from the upper and lower pure water supply nozzles 194*b*, 194*d* to scrub entire upper and lower surfaces of the semiconductor wafer W.

After the semiconductor wafer W has been scrubbed, the upper and lower roller sponges 192 are retracted upwardly and downwardly, respectively. Then, an etching liquid is supplied from the upper and lower chemical liquid supply nozzles 194*a*, 194*c* to the upper and lower surfaces, respectively, of the semiconductor wafer W for etching (chemically cleaning) the upper and lower surfaces of the semiconductor wafer W to remove metal ions remaining thereon. At this time, a rotational speed of the semiconductor wafer W may be varied as needed. Thereafter, pure water is supplied from the upper and lower pure water supply nozzles 194*b*, 194*d* to the upper and lower surfaces of the semiconductor wafer W for replacing the etching liquid with pure water to remove the etching liquid from the upper and lower surfaces of the semiconductor wafer W. At this time, the rotational speed of the semiconductor wafer W may also be varied as needed.

The semiconductor wafer W which has been subjected to the secondary cleaning in the cleaning unit 5 is transferred to the cleaning unit 6 by the second transfer robot 3. In the cleaning unit 6, the semiconductor wafer W is held by the rotating table 202 and rotated at low speeds ranging from 100 to 500 rpm ($min^{-1}$). The swing arm 204 is angularly moved over an entire upper surface of the semiconductor wafer W in such a state that ultrasonically vibrated pure water is supplied to the semiconductor wafer W from the nozzle 203 mounted on the swing arm 204, so that particles are removed from the upper surface of the semiconductor wafer W. After removal of particles from the semiconductor wafer W is completed, supply of the ultrasonically vibrated pure water from the nozzle 203 is stopped, and the swing arm 204 is moved back to its standby position. Then, the semiconductor wafer W is rotated by the rotating table 202 at high speeds ranging from 1500 to 5000 rpm ($min^{-1}$) to spin-dry the semiconductor wafer W. A clean inert gas may be supplied from the gas nozzle 205 as needed. A pencil-shaped cleaning member of sponge or the like may be used instead of or in addition to the ultrasonically vibrated pure water supplied to the semiconductor wafer W in this cleaning process. This pencil-shaped cleaning member is held in contact with the semiconductor wafer W and scanned to clean the semiconductor wafer W.

In the cleaning unit 6 where the semiconductor wafer W is finally cleaned, the semiconductor wafer W is dried. The first transfer robot 2 receives this dried semiconductor wafer W, and returns the semiconductor wafer W to one of the wafer cassettes C1, C2 on the loading/unloading stages 1.

A primary cleaning of the semiconductor wafer W may be conducted in the cleaning unit 5 and a secondary cleaning of the semiconductor wafer W may be conducted in the cleaning unit 6, without providing the cleaning devices 80 in the polishing unit 10.

The present invention offers the following advantages:

(1) Because needle-like projections on bevel and edge portions of a substrate are removed by a polishing process using a polishing tape, it is not necessary to protect a device-formed surface which would need to be protected by a resist in the conventional CDE process. As a result, two steps of coating a protective resist and peeling off the protective resist after needle-like projections have been removed can be omitted, resulting in an improved throughput. Since surfaces of the bevel and edge portions from which needle-like projections have been removed are made smooth, problems of the CDE process are solved.

(2) Because films deposited as a contaminant on a peripheral portion of a substrate are removed by a polishing process using a polishing tape, a removing process can be performed as a single process. Therefore, the films deposited as a contaminant can be removed in a period of time shorter than a period of time required by a conventional wet etching process, resulting in an improved throughput.

(3) With the edge-portion polisher according to the present invention, the polishing tape is sandwiched and pressed against upper and lower surfaces of an edge portion of a substrate such as a semiconductor wafer by a pair of clamp members. The polishing tape may be sandwiched and pressed against the edge portion of the semiconductor wafer by flat surfaces or roller surfaces. By pressing the polishing tape with the clamp members using an air cylinder or the like, a pressure for pressing the polishing tape against the edge portion of the substrate can be controlled at any desired value.

(4) With the bevel-portion polisher according to the present invention, while the polishing tape is being pressed against a bevel portion of a substrate by the polishing head having the resilient member, the substrate is rotated about its own axis to polish the bevel portion of the substrate.

(5) With the notch polisher according to the present invention, while the polishing tape is being pressed against a notch in a substrate using the resilient member, the polishing tape is moved with respect to the substrate, e.g., in one direction or a reciprocating manner to polish the notch in the substrate.

(6) After bevel and edge portions of a substrate have been polished by a polishing unit, the substrate is unloaded from the polishing unit, and cleaned and dried by a cleaning unit. With the substrate processing apparatus according to the present invention, the bevel and edge portions (and the notch in some cases) of the substrate are polished, and then the substrate is cleaned and dried, and this clean dry substrate is unloaded. Consequently, even if the substrate processing apparatus is installed in a clean room, because a polished substrate is clean and dry, the substrate unloaded from the substrate processing apparatus does not contaminate an atmosphere (clean air) in the clean room.

Although certain preferred embodiments of the present invention have been shown and described in detail, it should be understood that various changes and modifications may be made therein without departing from the scope of the appended claims.

What is claimed is:

1. A substrate processing apparatus for polishing a substrate, said substrate processing apparatus comprising:

a loading/unloading stage on which a cassette having a plurality of substrates is to be placed;

a polishing unit for polishing a substrate, said polishing unit including (i) an edge-portion polisher for pressing a first polishing tape against an edge portion of the substrate and causing relative movement between the first polishing tape and the substrate to polish the edge portion of the substrate;

(ii) a bevel-portion polisher for pressing a second polishing tape against a bevel portion of the substrate and causing relative movement between the second polishing tape and the substrate to polish the bevel portion of the substrate, (iii) a notch polisher for pressing a third polishing tape against a notch formed in the substrate and causing relative movement between the third polishing tape and the substrate to polish the notch of the substrate, and (iv) a cleaning device for conducting a primary cleaning of a polished substrate;

a transfer robot for transferring a substrate between a cassette, when on said loading/unloading stage, and said polishing unit; and an air supply system for supplying air so that pressure of said loading/unloading stage is greater than pressure of said polishing unit.

2. The substrate processing apparatus according to claim 1, wherein said edge-portion polisher includes two clamp members, and said edge portion polisher is structured to polish the edge-portion of the substrate by clamping upper and lower surfaces of the edge portion of the substrate through the first polishing tape by said two clamp members while the substrate is held and rotated by a substrate holding table.

3. The substrate processing apparatus according to claim 2, wherein said two clamp members are movable in a radial direction of the substrate, when held by the substrate holding table, for adjusting a radial position of the edge portion to be polished by said edge-portion polisher.

4. The substrate processing apparatus according to claim 2, wherein said edge-portion polisher further includes a roller guide for guiding the first polishing tape radially outwardly of the substrate, when held by the substrate holding table, between said two clamp members, and for guiding the first polishing tape from one of said two clamp members toward the other of said two clamp members.

5. The substrate processing apparatus according to claim 2, wherein said edge-portion polisher further includes a mechanism for opening and closing said two clamp members, with said two clamp members and said mechanism being vertically movable.

6. The substrate processing apparatus according to claim 1, wherein said bevel-portion polisher includes a polishing head having a resilient member, and said bevel-portion polisher is structured to polish the bevel portion of the substrate by pressing the second polishing tape against the bevel portion of the substrate with said polishing head while the substrate is held and rotated by a substrate holding table.

7. The substrate processing apparatus according to claim 6, wherein said polishing head is movable in a radial direction of the substrate when held by the substrate holding table.

8. The substrate processing apparatus according to claim 1, wherein said notch polisher includes a resilient member, and said notch polisher is structured to polish the notch of the substrate by pressing the third polishing tape against the notch in the substrate with said resilient member and moving the third polishing tape while the substrate is held by a substrate holding table.

9. The substrate processing apparatus according to claim 8, wherein said resilient member is vertically movable so that the third polishing tape is to be pressed against an upper edge, a radially outward edge, and a lower edge of the notch, selectively.

10. The substrate processing apparatus according to claim 1, further comprising:

a cleaning unit for cleaning and drying the substrate after the substrate has been polished by said polishing unit and removed from said polishing unit.

11. The substrate processing apparatus according to claim 1, further comprising:

an image sensor for imaging a region, being polished, of the substrate while the substrate is being polished; and a controller for processing an image obtained by said image sensor to determine a polishing state of the region being polished.

12. The substrate processing apparatus according to claim 11, wherein said controller is for detecting a polishing end point from the polishing state of the region being polished as determined by said controller.

13. The substrate processing apparatus according to claim 1, further comprising:

a photosensor for applying light to a region, being polished, of the substrate and detecting light reflected by the region being polished, while the substrate is being polished; and a controller for analyzing scattered light detected by said photosensor to determine a polishing state of the region being polished.

14. The substrate processing apparatus according to claim 13, wherein said controller is for detecting a polishing end point from the polishing state of the region being polished as determined by said controller.

15. The substrate processing apparatus according to claim 1, further comprising:

a controller for detecting a torque value to rotate the substrate, on a basis of a signal from a motor for rotating the substrate, while the substrate is being polished, and analyzing a change in the torque value.

16. The substrate processing apparatus according to claim 15, wherein said controller is for detecting a polishing end point from the change in the torque value as analyzed by said controller.

17. The substrate processing apparatus according to claim 1, further comprising:

a controller for detecting a torque value of a rotational shaft of a substrate holding table for holding and rotating the substrate while the substrate is being polished, and analyzing a change in the torque value.

18. The substrate processing apparatus according to claim 17, wherein said controller is for detecting a polishing end point from the change in the torque value as analyzed by said controller.

19. The substrate processing apparatus according to claim 1, further comprising:

a controller for measuring a tension applied to one of the first, second and third polishing tapes which is held in sliding contact with a region, being polished, of the substrate while the substrate is being polished, to determine a polishing state of the region being polished.

20. The substrate processing apparatus according to claim 19, further comprising:

a controller for measuring a tension applied to a portion of a member for pressing one of the first, second and third polishing tapes against a region, being polished, of the substrate while the substrate is being polished, to determine a polishing state of the region being polished.

* * * * *